US012715659B2

(12) United States Patent
Lamb et al.

(10) Patent No.: US 12,715,659 B2
(45) Date of Patent: Aug. 25, 2026

(54) BAG CLOSURE AND CONTAINER SYSTEM FOR MEDICAL LIQUIDS INCORPORATING SAME

(71) Applicant: Fresenius Medical Care Holdings, Inc., Waltham, MA (US)

(72) Inventors: Jared Lamb, Ogden, UT (US); Evan Harb, Ogden, UT (US)

(73) Assignee: FRESENIUS MEDICAL CARE HOLDINGS, INC., Waltham, MA (US)

( * ) Notice: Subject to any disclaimer, the term of this patent is extended or adjusted under 35 U.S.C. 154(b) by 304 days.

(21) Appl. No.: 18/380,668

(22) Filed: Oct. 17, 2023

(65) Prior Publication Data

US 2024/0150084 A1 May 9, 2024

Related U.S. Application Data

(60) Provisional application No. 63/423,526, filed on Nov. 8, 2022.

(51) Int. Cl.
*B65D 41/02* (2006.01)
*B65D 75/58* (2006.01)

(52) U.S. Cl.
CPC ..... *B65D 41/02* (2013.01); *B65D 75/5883* (2013.01); *B65D 2575/583* (2013.01)

(58) Field of Classification Search
CPC ..... B65D 41/02; B65D 75/5883; B65D 2575/583
See application file for complete search history.

(56) References Cited

U.S. PATENT DOCUMENTS

| | | | |
|---|---|---|---|
| 4,017,020 | A | 4/1977 | Frank |
| 5,439,454 | A | 8/1995 | Lo et al. |
| 5,976,300 | A | 11/1999 | Buchanan et al. |
| 6,127,009 | A | 10/2000 | Strassmann |
| 6,207,107 | B1 | 3/2001 | Debrauwere et al. |

(Continued)

FOREIGN PATENT DOCUMENTS

| | | | |
|---|---|---|---|
| DE | 19617024 | A1 | 11/1997 |
| EP | 1084691 | A2 | 3/2001 |

(Continued)

OTHER PUBLICATIONS

International Search Report and Written Opinion issued in corresponding International patent Application No. PCT/US2023/035259 dated Mar. 1, 2024 (14 pages).

*Primary Examiner* — Frederick C Nicolas
(74) *Attorney, Agent, or Firm* — Kilyk & Bowersox, P.L.L.C.

(57) ABSTRACT

A bag closure and a container system incorporating the bag closure, are provided. The container system can be used for preparing and holding medical liquids such as peritoneal dialysis solutions. The bag closure can be in the form of an assembly of a bag connector made of a first material, and a nozzle made of a different material. By using two different materials, bonding of the bag closure to a bag of a first material and to a tube of a second, different material, can be facilitated. Alternatively, the bag closure can be of a one-piece, monolithic construction made from a singular material. Methods of making the bag closure and the container system are also provided.

18 Claims, 12 Drawing Sheets

(56) References Cited

U.S. PATENT DOCUMENTS

| | | | | |
|---|---|---|---|---|
| 6,364,143 | B1 | 4/2002 | Knierbein | |
| 6,428,518 | B1 | 8/2002 | Brengle et al. | |
| 6,485,479 | B1 | 11/2002 | Knierbein | |
| 10,737,852 | B2 * | 8/2020 | Ohkubo | B65D 47/36 |
| 11,419,791 | B2 * | 8/2022 | Jensen | A61M 1/167 |
| 12,076,469 | B2 * | 9/2024 | Jensen | A61J 1/1406 |
| 2002/0058927 | A1 | 5/2002 | Becker et al. | |
| 2003/0000632 | A1 | 1/2003 | Sperko et al. | |
| 2003/0168120 | A1 | 9/2003 | Brehm et al. | |
| 2003/0187421 | A1 | 10/2003 | Manica et al. | |
| 2005/0040181 | A1 | 2/2005 | Kurosawa et al. | |
| 2005/0096625 | A1 | 5/2005 | Brandl et al. | |
| 2011/0189431 | A1 | 8/2011 | Nicola et al. | |
| 2017/0225852 | A1 | 8/2017 | Ohkubo et al. | |
| 2018/0117295 | A1 | 5/2018 | Wolkenstoerfer et al. | |
| 2020/0222281 | A1 | 7/2020 | Ding et al. | |
| 2021/0299971 | A1 | 9/2021 | Wittorf et al. | |

FOREIGN PATENT DOCUMENTS

| | | | |
|---|---|---|---|
| JP | H10194307 | A | 7/1998 |
| WO | 0003921 | A2 | 1/2000 |
| WO | 2012101982 | A1 | 8/2012 |
| WO | 2012126925 | A1 | 9/2012 |
| WO | 2015102494 | A1 | 7/2015 |
| WO | 2020009789 | A1 | 1/2020 |

* cited by examiner

BAG CLOSURE AND CONTAINER SYSTEM FOR MEDICAL LIQUIDS INCORPORATING SAME

This application claims the benefit under 35 U.S.C. § 119(e) of prior U.S. Provisional Patent Application No. 63/423,526, filed Nov. 8, 2022, which is incorporated in its entirety by reference herein.

FIELD

The present invention relates generally to container systems that may be used, for example, in preparing and delivering solutions to patients, such as solutions for dialysis.

BACKGROUND

Dialysis is commonly used to replace kidney function lost by kidney disease. Most importantly, dialysis is designed to remove waste toxins and excess water from the blood. In one type of dialysis—hemodialysis (HD)—toxins are filtered from a patient's blood through a semi-permeable membrane in a dialyzer, and into a volume of external dialysis solution. The waste and toxins dialyze out of the blood through the membrane into the dialysis solution, and the dialysis solution is then discarded.

Peritoneal dialysis (PD) is an alternative method that makes use of a natural, semi-permeable membrane surrounding the walls of the patient's abdomen or peritoneal cavity (i.e., the peritoneum). During a PD procedure, a solution is introduced into the patient's abdomen, where it remains for up to several hours, removing toxins via diffusion across the membrane. This solution is then drained from the body along with the toxins diffused therein.

Dialysis solutions generally include water and glucose, electrolytes (e.g., sodium, calcium, potassium, chlorine, magnesium, and the like), acids (e.g., citric acid, acetic acid, and the like), and/or bases (e.g., bicarbonate). These solutions may be premixed or may be shipped as concentrates or powders to be mixed to a final concentration at a point of use. Premixed solutions are more expensive to ship and store. Shipping and storing concentrates or powders is cheaper, but increases costs for mixing on-site at the time of use, for example, due to the additional steps of mixing involved by a medical practitioner.

Mixing requires addition of purified water and agitation over a period of time to ensure a solution is of uniform concentration. Conventional dialysis processes may require the use of one supply line to add liquid to a solution container and a second line to remove liquid from the solution container. The need for multiple, different lines complicates the manufacture and use of dialysis treatment disposables, and increases costs.

A need exists for an inexpensive, easy, and safe way to prepare dialysis solutions without a need to ship heavy bags of solution.

SUMMARY

It is an object of the present invention to provide an inexpensive, easy, and safe way to prepare dialysis solutions without a need to ship heavy bags of solution.

It is an object of the present invention to provide a bag closure that provides a leak-free container system for medical fluids.

It is an object of the present invention to provide a bag closure that can heat weld bond to a flexible wall material and solvent bond to a different, tube material.

It is an object of the present invention to provide a bag closure that can heat weld bond to a polypropylene-containing dialysis solution bag material and solvent bond to a polyvinyl chloride tube material.

It is an object of the present invention to provide a container system that includes a bag closure that is heat weld bonded to a flexible wall material and solvent bond to a different, tube material.

It is an object of the present invention to provide a container system wherein a bag closure is heat weld bonded to a polypropylene-containing dialysis solution bag material and solvent bond to a polyvinyl chloride tube material.

It is an object of the present invention to provide a bag closure that can heat weld bond to a flexible wall polymeric material and solvent bond to a tube made of the same polymeric material.

The present invention provides a bag closure and a container system that includes the bag closure. The bag closure comprises a bag connector having a main body, a first wing, and a second wing. Each of the first wing and the second wing extends laterally from a respective opposing side of the main body. The main body comprises an inner surface that defines a nozzle receptacle, and an opening that forms a fluid communication between the nozzle receptacle and a volume outside of the main body.

The bag closure comprises the nozzle that includes a hollow body having a wall that defines an interior volume within the hollow body. At least one orifice is provided that forms a fluid communication between the interior volume and the outside of the nozzle. The nozzle can comprise the same material as, or a different material than, the bag connector.

The nozzle is seated within the nozzle receptacle of the bag connector, and the least one orifice and the opening are positioned such that a fluid communication is formed between the interior volume of the hollow body and the outside of the bag closure.

The bag closure can include two different materials, with the material of the bag connector being intended to heat weld to a flexible wall material, and the material of the nozzle being intended to solvent bond to a conduit or tube.

The bag closure can be of a single material, or of two or more materials. The bag connector material and the nozzle material can be selected so that the bag closure can sealingly connect to a selected flexible wall, or bag, material, and the nozzle can sealingly connect to a selected tube material. For example, the bag connector can comprise a polypropylene material that can heat weld bond to a polypropylene-containing flexible wall material, and the nozzle can comprise polycarbonate that can solvent bond to a polyvinyl chloride tube.

In other embodiments, a one-piece, monolithic bag closure is provided.

BRIEF DESCRIPTION OF THE DRAWINGS

The present invention may be more fully understood with reference to the attached drawings that form a part of the present disclosure. The drawings are intended to exemplify, not limit, the invention.

DETAILED DESCRIPTION

Figure 1:
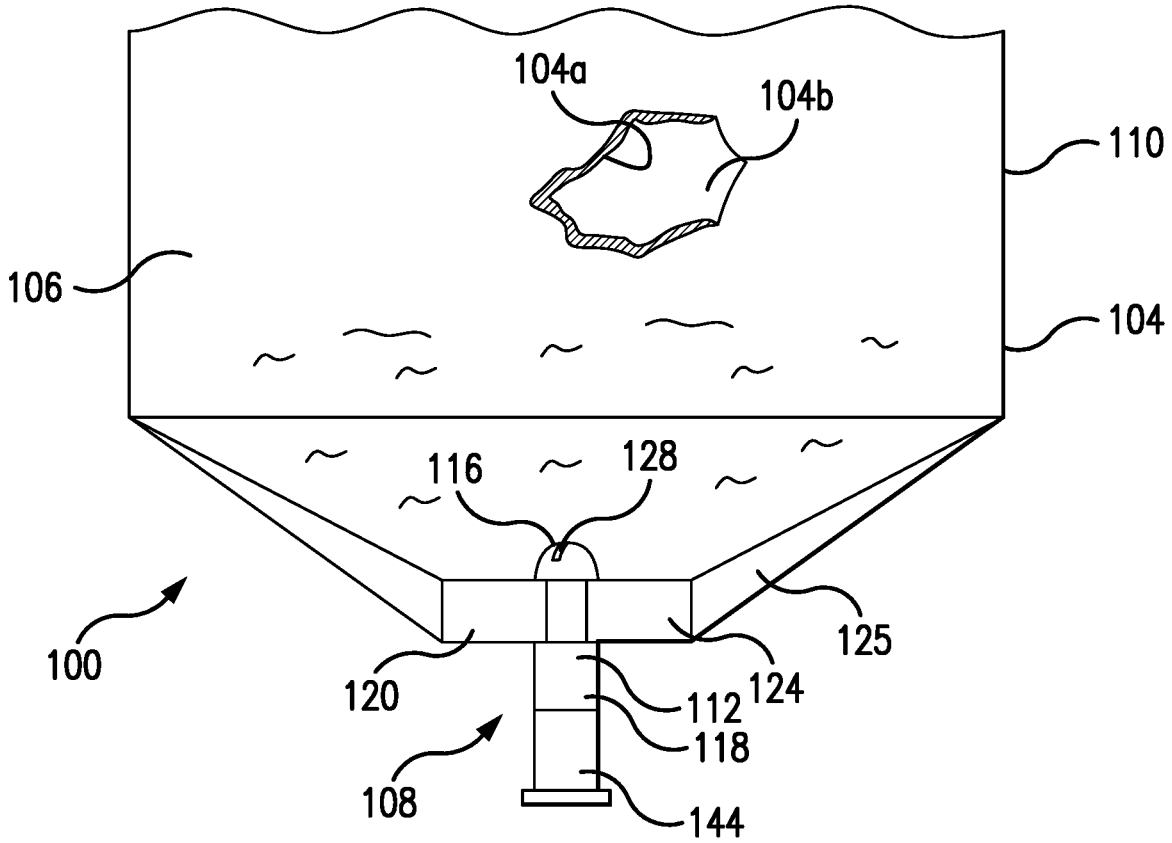
FIG. 1 is a front view of a container system including a bag closure according to an exemplary embodiment of the present invention, sealed to a bottom section of a flexible wall of a flexible bag.

A container system is provided that includes at least one flexible wall defining a compartment, for containing a dissolvable solid or dilutable concentrate, and a bag closure coupled to an end of the at least one flexible wall. The bag closure can comprise a bag connector and nozzle assembly or can be of single piece construction. The at least one flexible wall can define a bag. A support, for example, a hanger or hanger hole can be provided adjacent a first end of the at least one flexible wall, and the bag closure can be coupled to a second end of the at least one flexible wall. The second end can be distal or opposite the first end. The bag closure can comprise an assembly including a hollow body nozzle and a bag connector. The hollow body nozzle defines a longitudinal axis and one or more orifices through a wall thereof, for example, through an end wall thereof. Each orifice is able to form a fluid communication between an interior volume or inner cavity within the hollow body, and the compartment.

The bag closure can comprise a bag connector that includes a nozzle seat and is configured or formed to house the hollow body nozzle. Regardless of the material of the nozzle, the material of the bag connector can be matched to or selected to be compatible with, the material of the at least one flexible wall. "Compatible" as used herein means or includes the ability of one material being able to bond (e.g., chemical bond, heat bond, or solvent bond) to another material and stay bonded together such that the bonded materials are able to be used as a bag closure. As such, good bonding, for example, by heat welding, can be provided between the bag connector and the at least one flexible wall, enabling a leak-free communication between the bag closure and the at least one flexible wall. The material of the bag connector does not necessarily need to be identical to the material of the at least one flexible wall, but the materials can be similar, can use common polymers or similar blends of polymers, or can otherwise be chosen so that good bonding between the materials can result. For instance, the materials can have the same main polymer present, meaning, the polymer present in the largest weight % can be the same for each of the materials. As an example, the bag connector can comprise polypropylene whereas the material of the at least one flexible wall can comprise a polypropylene blend. Other polyalkylene materials and polyalkylene blends can be used.

The material of the nozzle can differ from the material of the bag connector, and does not need to bond directly to the material of the at least one flexible wall. The use of one material for the bag connector and a different material for the nozzle enables heat bonding of the bag closure, at the bag connector, to the flexible wall material, and heat bonding of a tube, made of a different material than the flexible wall, to the nozzle. As an example, by making the bag connector of a polypropylene material or that comprises a polypropylene material, the bag connector can readily heat bond to a flexible wall that comprises a polypropylene material, and by making the nozzle of a polycarbonate material, the nozzle can readily bond to a polyvinyl chloride tube. The bag closure can thus bond to two different materials. To enable the bag connector and nozzle to be formed into a leak-free assembly, co-molding methods, over-molding methods, two-shot molding methods, heat bonding methods, solvent bonding methods, 3D printing methods, combinations thereof, and the like, can be used.

Methods of making the container system are also provided as are methods of preparing a medical solution, for example, a dialysis solution, using the container system.

The bag connector can comprise a main body, a first wing, and a second wing. Each of the first wing and the second wing can extends laterally from opposing sides of the main body. The main body can comprise an inner surface that defines a nozzle receptacle or a nozzle seat, and an opening that forms a fluid communication between the nozzle receptacle and an outside of the main body. The thickness of each of the first wing and the second wing can gradually decrease toward opposing ends, such that the bag connector can have a diamond-shaped top, a diamond-shaped bottom, and a diamond-shaped cross-section from top to bottom. The bag connector can comprise a polymer (e.g., a homopolymer, a copolymer), a polymer blend, a polyalkylene polymer, a polyalkylene blend, polypropylene, or the like.

The nozzle can comprise a hollow body having a wall that defines an interior volume within the hollow body. At least one orifice can be formed or provided in the wall, which forms a fluid communication between the interior volume and an outside of the nozzle. The nozzle can comprise a non-polypropylene thermoplastic, for example, polycarbonate, polyvinyl chloride, or the like.

The nozzle can be seated within the nozzle receptacle of the bag connector. The at least one orifice and the opening can be positioned such that a fluid communication is formed between the interior volume of the hollow body, through the orifice, and to outside the bag closure. The hollow body can comprise an outer surface having a cylindrical shape and the nozzle receptacle can be shaped to compliment the cylindrical outer shape of the hollow body. The nozzle can further comprise a tube seat configured to receive and secure a tube therein. The tube seat can comprise a polymeric material, a thermoplastic material, a non-polypropylene thermoplastic, polycarbonate, polyvinyl chloride, or the like. The tube seat can comprise a ledge or shoulder and the bag connector can comprise a bottom edge that is configured and sized to abut the ledge or shoulder. A tube can be bonded to the tube seat, for example, by heat welding, by adhesive bonding, by solvent bonding, by a ring clamp, by a threaded connection, or the like.

The inner surface of the main body of the bag connector can further define at least one annular groove within the nozzle receptacle. An outer surface of the wall of the nozzle can define at least one annular protrusion that fits within the annular groove within the nozzle receptacle.

The nozzle can comprise a tip comprising the at least one orifice. The tip of the nozzle can extend through the opening of the bag connector and outside of the bag connector. The tip can comprise a dome. The at least one orifice can comprise at least one circular opening. Each circular opening can have a diameter of from 0.01 inch to 0.05 inch, for example, from 0.02 inch to 0.03 inch, or a diameter of 0.026 inch or 0.0258 inch. The at least one orifice can comprise two orifices, three orifices, four orifices, five orifices, six orifices, or more. The at least one orifice can be one or more slots, with each slot having a length disposed in a direction from a base of the dome to an apex of the dome. The at least one orifice can comprise a first orifice and a second orifice disposed on opposing sides of the dome.

Each orifice can be configured to deliver liquid from the interior volume or inner cavity, to the compartment, for example, in a direction that is at an angle of from 5° to 85° relative to the longitudinal axis, for example, at an angle of from 15° to 80° relative to the longitudinal axis, at angle of from 25° to 75° relative to the longitudinal axis, or at an angle of from 35° to 65° relative to the longitudinal axis. Greater details about nozzles, nozzle tips, orifices, and other nozzle and bag closure features that can be used according to the present invention, can be found in U.S. Patent Application Publication No. US 2020/0009018 A1 to Jensen et al., which is incorporated herein in its entirety by reference.

The nozzle can further comprise or define a particulate trap, for example, at an end of the nozzle or at the tip of the nozzle. The nozzle can comprise a dome and a particulate trap, and the particulate trap can protrude from an apex of the dome.

The bag connector main body can comprise a dome. The dome can protrude from a top end of the main body, and the opening of the bag connector can be defined through the dome. The bag connector can instead, or additionally, define the nozzle orifice, for example, an orifice formed through a dome protruding from a top end of the main body. Similar to the orifice described herein, defined by the nozzle, the bag connector can include a dome and an opening in the form of a slot, through the dome. The slot can have a length disposed in a direction from a base of the dome to an apex of the dome. The bag connector main body can further comprise a particulate trap that protrudes from the apex of the dome.

The present invention also provides a container system. The container system can comprise at least one flexible wall, and a bag connector and nozzle assembly as described herein. The at least one flexible wall can comprise one wall, two walls, three walls, four walls, a bag, or the like. The at least one flexible wall can define a compartment containing a dissolvable solid or a dissolvable or dilutable concentrate. The at least one flexible wall can comprise a polymeric material, a polyalkylene material, a polymer blend, a polyalkylene blend, polypropylene, combinations thereof, and the like. The material of the at least one flexible wall can comprise BIOFINE®, a PVC-free bag material available from Fresenius Medical Care North America, of Waltham, Massachusetts. When a polypropylene polymer or polypropylene blend is used for the at least one flexible wall, particularly good bonding can be achieved with the bag connector when the bag connector also comprises a polypropylene polymer or polypropylene blend. Other combinations of flexible wall material and bag connector materials can be selected such that the materials are the same, or similar, or exhibit similar properties, such that good bonding between the flexible wall material and the bag connector material can be achieved.

The at least one flexible wall can be bonded to the bag connector, for example, by heat welding, heat shrinking, or the like, to form a container system. The bag connector and the nozzle can be formed such that the nozzle is seated within the nozzle receptacle of the bag connector, and a fluid communication is formed between the interior volume of the hollow body and the compartment made of the at least one flexible wall. The at least one flexible wall can comprise a support adjacent a first end thereof, and the bag connector can be coupled to a second end of the at least one flexible wall, for example, wherein the second end is opposite or distal from the first end. The bag connector can be coupled to the at least one flexible wall at the first wing and at the second wing. The thickness of each of the first wing and of the second wing can gradually decrease in a direction toward opposing ends of the bag connector.

As with the bag connector and nozzle assembly described herein, the nozzle of the container system can further comprise a tube seat configured to receive and secure a tube therein. The tube seat can comprise a polymer, a plastic, a non-polypropylene thermoplastic, or the like. The tube seat can comprise polycarbonate, polyvinyl chloride, or the like. The tube seat can comprise a ledge or shoulder and the bag connector can comprise a bottom edge that abuts the ledge or shoulder.

In some embodiments, rather than comprising an assembly, the bag closure can be formed as a monolithic, one-piece closure, for example, by a one-shot molding process using a singular material. Injection molding, extrusion molding, casting, and 3D printing methods can be used. The nozzle can be formed as part of the main body rather than as a separately manufactured component. For intended uses where the material of the flexible wall and the material of a tubing intended to connect to the bag closure is the same, or where the material of the flexible wall and the material of the tubing are both bondable to a single bag closure material, for example, heat-bond compatible with a single bag closure material, then such a single bag closure material can be used. Such would be the case, for example, if the flexible wall material, that is, the compartment material or bag material, comprises polyvinyl chloride, and the tube comprises polyvinyl chloride. Under such circumstances, the bag closure could be made of a single compatible material, for example, polycarbonate or polyvinyl chloride.

An exemplary, one-piece, monolithic bag closure can comprise a main body, a first wing, a second wing, an inner cavity, a nozzle, and a tube port. Each of the first wing and the second wing extends laterally from a respective opposing side of the main body. The inner cavity has a first end and a second end, and the first end terminates with the nozzle. The second end of the inner cavity at least partially defines the tube port. The nozzle includes at least one orifice that forms a fluid communication between the inner cavity, in-use, the interior of a compartment. A fluid communication is also formed from the tube port, through the inner cavity, and through the nozzle. The nozzle has a proximal end adjacent the tube port, and an opposite, distal end. The distal end of the nozzle can be a closed end. The nozzle can have one or more nozzle orifices. The tube port can have a longitudinal axis, and the one or more nozzle orifices can be configured to direct liquid out of the nozzle at an angle with respect to the longitudinal axis.

The single material bag closure can be part of a container system that also comprises at least one flexible wall defining a compartment. The compartment has an interior. The at least one flexible wall can comprise a first polymer or a polymeric blend comprising the first polymer. As an example, the at least one flexible wall can comprise polyvinyl chloride. The bag closure can comprise, for example, the first polymer, a polymeric blend comprising the first polymer, or a polymeric material that is heat-bond compatible with the first polymer. As an example, the at least one flexible wall can comprise polyvinyl chloride and the bag closure can comprise polycarbonate or polyvinyl chloride.

The container system can be formed by heat-welding bonding or otherwise bonding the at least one flexible wall to the bag closure. The heat-welding can be carried out at an end of the compartment such that the end of the compartment is closed but-for a through-passage from the tube port to the interior of the compartment. The compartment can contain a dissolvable solid, a dilutable concentrate, powdered electrolytes, or the like, herein also referred to as contents. The compartment can contain the dissolvable solid, dilutable concentrate, powdered electrolytes, or the like, before bonding with the bag closure, or the compartment can be loaded with the dissolvable solid, dilutable concentrate, powdered electrolytes, or the like, after bonding with the bag closure. The contents can be provided in a frangible contents compartment, for example, a frangible pack, pod, or mini-compartment within the container system. The frangible contents compartment can be, for example, adhered or sealed to an inner wall of the main compartment or bag of the container system. The frangible contents compartment can include a frangible seal or a frangible sidewall. The frangible contents compartment can be provided with an easily rupturable seal, for example, along an edge or along a sidewall thereof, which, when ruptured, releases the contents into the interior of the main compartment of the container system. Alternatively, or additionally, powdered or otherwise solid contents, or concentrated liquid contents, can be sprayed onto the inner sidewall of the main compartment, to form a coating that can then be dissolved when water or saline is added to the container system.

The container system can further comprise a tube bonded to the tube port such that a fluid communication is provided through the tube and into the interior of the compartment. In the case where the tube comprises polyvinyl chloride, the bag closure can comprise polycarbonate, polyvinyl chloride, and another polymeric material that is heat-bond compatible with the polyvinyl chloride tube. The first polymer can comprise polyvinyl chloride and the tube can comprise polyvinyl chloride, in which case the bag closure can comprise polycarbonate or polyvinyl chloride. The at least one flexible wall and the tube can be of the same material and the bag closure can also be made of the same material or of a different, but heat-bond compatible material.

A method is also provided by the present invention and comprises forming a bag closure comprising an assembly of a bag connector and a nozzle. The bag connector and a nozzle can be as described herein. The nozzle can comprise a hollow body having a wall that defines an interior volume within the hollow body, and at least one orifice that forms a fluid communication between the interior volume, and through the orifice, to outside the bag closure. The nozzle can comprise a non-polypropylene thermoplastic material. Forming the bag closure can comprise forming the bag connector around the nozzle to form a bag connector and nozzle assembly.

The bag connector can be formed, for example, by molding or 3D printing to define a main body, a first wing, and a second wing. Each of the first wing and the second wing extends laterally from a respective opposing side of the main body. The main body can comprise an inner surface that defines a nozzle receptacle, and an opening that forms a fluid communication between the nozzle receptacle to the outside. The bag connector can comprise polypropylene. The forming can be carried out to result in the nozzle being seated within the nozzle receptacle of the bag connector. The at least one orifice and the opening can be positioned such that a fluid communication is formed between the interior volume of the hollow body nozzle to outside of the bag closure.

The method can also involve separately, or simultaneously, forming the nozzle. Forming the bag connector around the nozzle, and the forming the nozzle, can be carried out by co-molding the nozzle and the bag connector. Alternatively, forming the bag connector around the nozzle can comprise over-molding the bag connector around the nozzle. The nozzle and the bag connector can be 3D printed, separately, or together. A two-shot molding process can be used. The nozzle can be separately formed, placed in a mold, and then over-molded with a different material to form the bag connector. The nozzle can be separately formed, and then the bag connector can be 3D printed over the nozzle.

The method can further comprise heat-welding the bag connector to the nozzle. Forming the bag connector around the nozzle can comprise forming the bag connector in two parts, arranging the two parts around the nozzle, and heat-welding the two parts together.

Subsequent to forming the bag connector and nozzle assembly, the method can further comprise bonding at least one flexible wall defining a compartment, to the bag connector and nozzle assembly. The at least one flexible wall defining a compartment can contain a dissolvable solid, dilutable concentrate, powdered electrolytes, or the like. The at least one flexible wall can comprise, for example, polypropylene. The at least one flexible wall can define a bag and the bag can comprise a PVC-free material. The bonding of the flexible wall to the bag closure can comprise heat welding the flexible wall to the first wing and to the second wing of the bag connector.

The bonding results in a container system that includes a fluid communication between the interior volume of the hollow body nozzle and the compartment formed by the at least one flexible wall. The bonding can involve heat bonding. A frangible seal can be provided, or formed, to close-off, protect, and/or keep sterile, the fluid communication. The frangible seal can be a plastic seal, an adhesive seal, a foil seal, or the like. The frangible seal can prevent leakage of contents from the compartment.

FIG. 1 is a front view of a container system 100 including a bag closure 108 of an embodiment of the present invention. Bag closure 108 is sealed to a bottom section of a flexible wall 104 of a flexible bag. Container system 100 is illustrated as including at least one flexible wall 104 defining a compartment 106. For example, at least one flexible wall 104 shown in FIG. 1 includes a front wall 104*a* and a rear wall 104*b*, and a seam 110 connecting front wall 104*a* to rear wall 104*b*. Flexible wall 104 can be or include polypropylene, a polypropylene blend, other polyalkylene materials, polyalkylene blends, and the like, and can comprise multiple layers, for example, five, six, seven, eight, or nine different layers, each of the same material, each of a different material, or a combination thereof. Flexible wall 104 can be, for example, a single material, or layers or blends of different materials.

Container system 100 shown in FIG. 1 includes only a single compartment 106, but any number of compartments 106 can be defined by flexible wall 104. Seam 110 can be a continuous or nearly continuous seal surrounding compartment 106. In some embodiments, flexible wall 104 is a single wall, for example, a generally cylindrical wall. Flexible wall 104 and seam 110 can substantially enclose compartment 106. Seam 110, for example, can be formed by a melt-bonded portion of flexible wall 104, an ultrasonically welded portion of flexible wall 104, an adhesive, or the like.

Compartment 106 can contain a dissolvable solid or a concentrate, such as a liquid, typically with a compound dissolved therein, which is used to form a dialyzing solution. For example, compartment 106 can contain sodium bicarbonate, sodium chloride, dextrose, a buffer, an electrolyte, calcium, magnesium, potassium, sodium, other electrolytes, combinations thereof, and the like.

Container system 100 can include a support (not shown) to facilitate maintaining the container system 100 in an upright position, as shown in FIG. 1. For example, the support can include a hole through flexible wall 104, a hook, a strap, a clamp, or another structure adapted to attach container system 100 to a fixed or movable object, such as an IV pole or the like. In some embodiments, the support includes a portion of seam 110, to which a clamp or other device can be attached.

As mentioned above, container system 100 includes bag closure 108. Bag closure 108 includes a bag connector 112 and a nozzle 116 disposed partially inside bag connector 112. Nozzle 116 includes an orifice 128 disposed within compartment 106. Nozzle 116 further includes a tube seat 144 with which a fluid conduit or tube, for example, a catheter tube, can couple, thus providing a fluid connection to compartment 106 through orifice 128.

Bag connector 112 can comprise a material that is heat-weldable to and with the material of the contacting surface of flexible wall 104. Bag connector 112 includes a main body 118, and a first wing 120 and second wing 124 each of which extends laterally from a respective opposing side of main body 118. Bag connector 112 can be coupled to an end of flexible wall 104 at an opposite end of compartment 106, relative to the end having a support or support feature. The configuration can be such that, when container system 100 is hanging from a structure, bag connector 112 is at the bottom of compartment 106.

As mentioned above, seam 110 can be formed by heat-welding, melt-bonding, ultrasonic welding, adhesives, or the like. Additional material of flexible wall 104 at seam 110 can be bonded together at the end of flexible wall 104 where flexible wall 104 attaches to bag connector 112. The additional material of flexible wall 104 can provided added strength to a tapering seal 125. The additional material is further bonded to a front face of first and second wings 120, 124, and to a rear face of first and second wings 120, 124, by heat-welding melt-bonding, ultrasonic welding, solvent bonding, adhesives, or the like, to form a sealed connection between bag connector 112 and flexible wall 104. Bag connector 112 is sealed to flexible wall 104 such that nozzle 116 is in fluid communication with the interior of compartment 106.

Figure 2B:
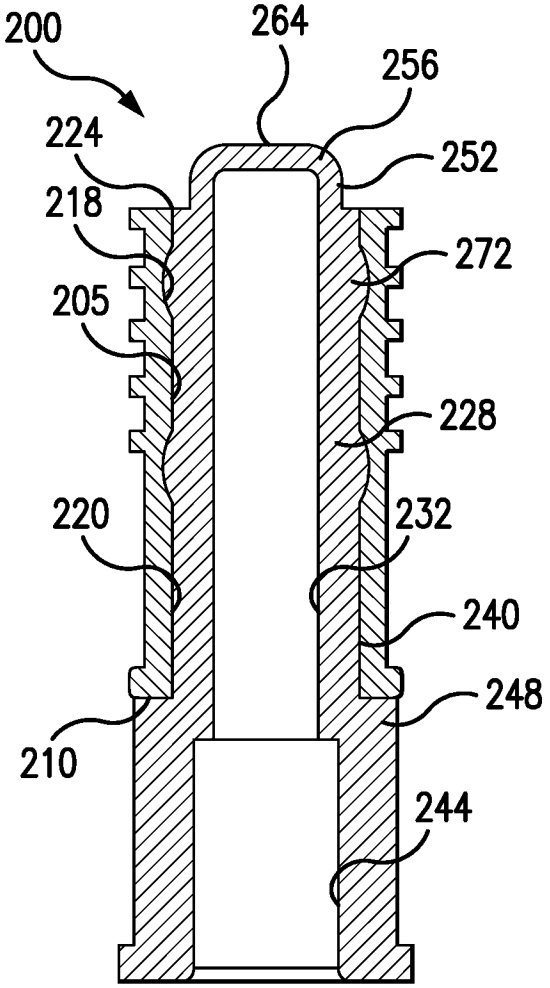
FIG. 2B is a cross-sectional view of the bag closure shown in FIG. 2A and taken along line A-A of FIG. 2A.
Figure 2A:
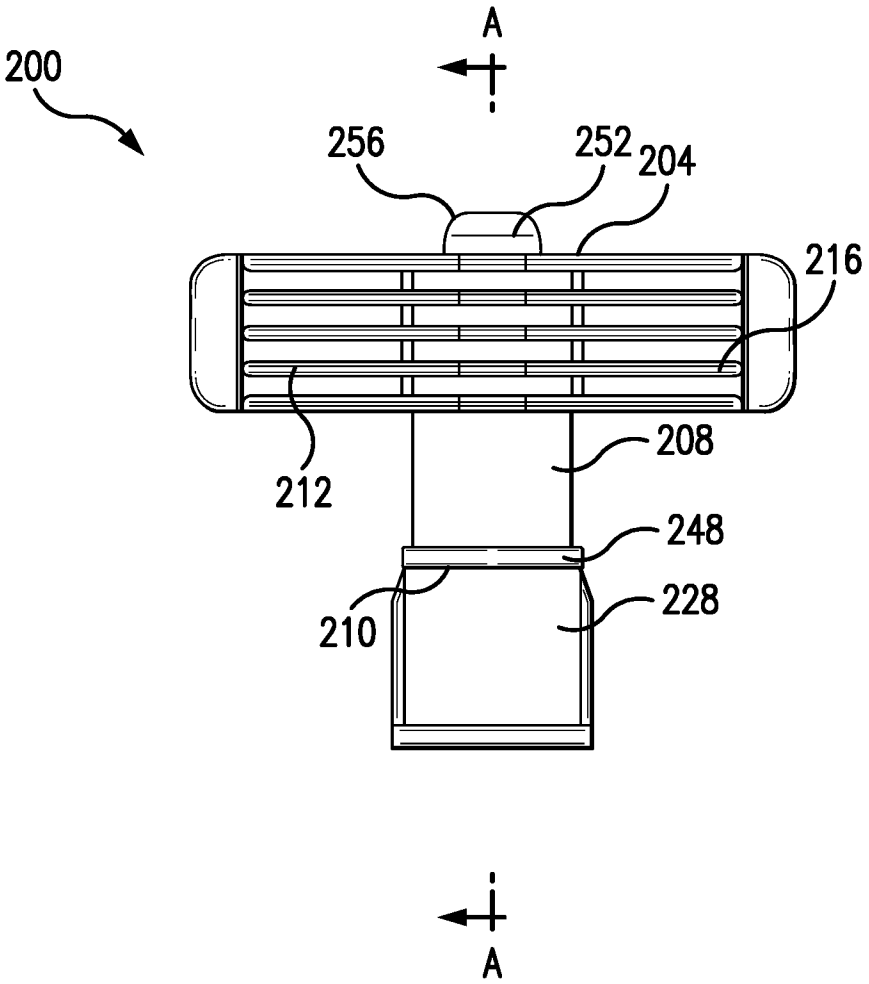
FIG. 2A is a front view of a bag closure according to an embodiment of the present invention.
Figure 2D:
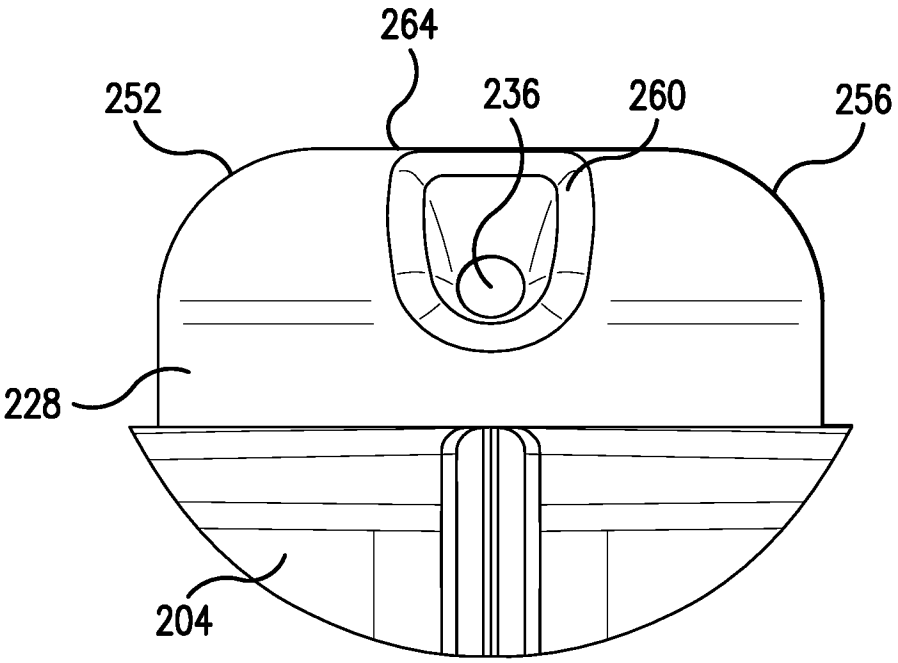
FIG. 2D is an enlarged view of the bag closure shown in FIGS. 2A-2C, taken along section C shown in FIG. 2C.
Figure 2C:
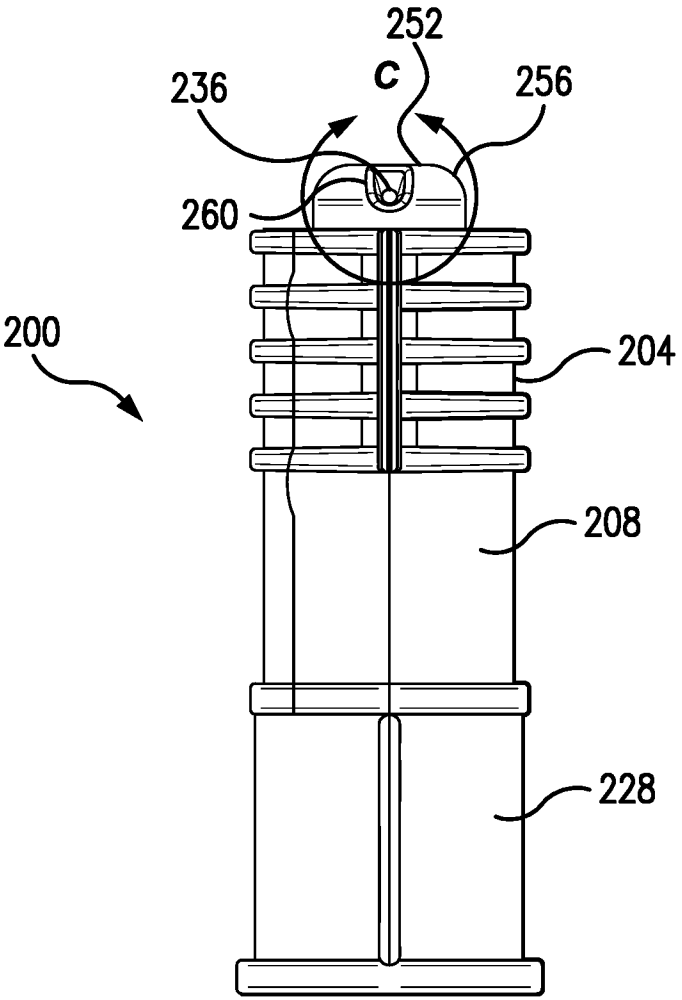
FIG. 2C is a side view of the bag closure of shown in FIG. 2A.
Figure 2E:
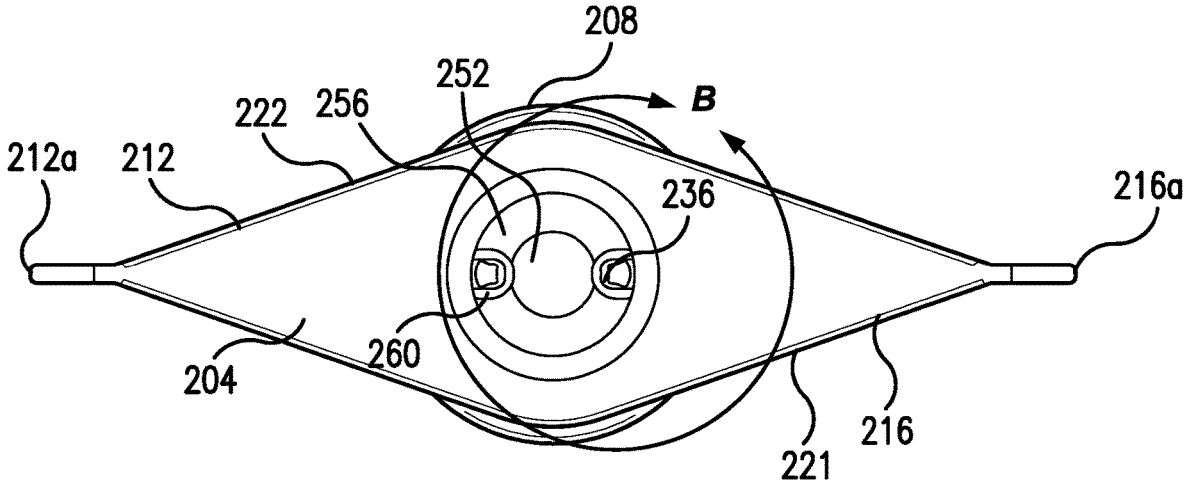
FIG. 2E is a top view of the bag closure shown in FIGS. 2A-2D.
Figure 2F:
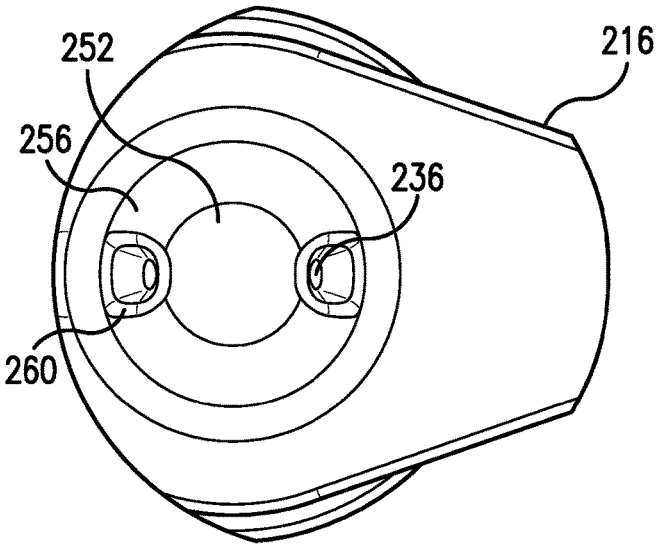
FIG. 2F is an enlarged view of the bag closure shown in FIGS. 2A-2E, taken along section B in FIG. 2E.

FIG. 2A is a front view of a bag closure 200. According to an embodiment of the present invention. FIG. 2B is an enlarged cross-sectional view of bag closure 200, taken along line A-A of FIG. 2A. FIG. 2C is a side view of bag closure 200 and FIG. 2D is an enlarged sectional view of bag closure 200 taken from section C of FIG. 2C. FIG. 2E is a top view of bag closure 200 and FIG. 2F is an enlarged sectional view of bag closure 200 taken from section B of FIG. 2E.

As shown in FIGS. 2A-2F, bag closure 200 includes a bag connector 204 and a nozzle 228. As mentioned above, bag connector 204 can be made of or otherwise comprise polypropylene, a polypropylene blend, or another material that heat-weld bonds to the material of a polypropylene-containing flexible, for example, the flexible wall illustrated in FIG. 1. Nozzle 228 can be made of a polymer that is different from polypropylene, such as non-polypropylene thermoplastic, polycarbonate, polyvinyl chloride, or the like. Accordingly, nozzle 228 can easily couple to a tube made of the same or a similar material. For example, nozzle 228 can be made of polycarbonate or polyvinyl chloride and the tube that couples to nozzle 228 can also be made of polyvinyl chloride.

Bag connector 204 and nozzle 228 can be manufactured such that bag connector 204 surrounds the side wall of nozzle 228. In such a configuration, bag connector 204 and nozzle 228 are mechanically coupled together and cannot easily be separated from one another. For example, bag connector 204 and nozzle 228 can be manufactured by co-molding bag connector 204 around nozzle 228. Alternatively, forming bag connector 204 around nozzle 228 can comprise over-molding bag connector 204 around nozzle 228. Nozzle 228 and bag connector 204 can be 3D printed, separately, or together. A two-shot molding process can be used. Nozzle 228 can be separately formed, placed in a mold, and then over-molded with a different material to form bag connector 204. Nozzle 228 can be separately formed, and then bag connector 204 can be 3D printed over nozzle 228.

One or more rotation-locking features, for example, fins, can be provided along the outer sidewall of nozzle 228 to prevent nozzle 228 from rotating with respect to bag connector 204 once assembled or molded together. One or more axial displacement locking features and can be provided along the outer sidewall of nozzle 228 to prevent nozzle 228 from moving axially with respect to bag connector 204 once assembled or molded together.

Bag connector 204 includes a main body 208, a first wing 212, and a second wing 216. Each of first wing 212 and second wing 216 extends laterally from a respective opposing side of main body 208. Each of first wing 212 and second wing 216 further includes a front face 221 and a rear face 222 as best seen in FIG. 2E. Front face 221 and a rear face 222 are intended to bond to a flexible wall material and can be provided with heat-welding features for this purpose, for example, provided with grooves, conformable ridges, meltable ridges, or the like. Main body 208 includes an inner surface 220 (FIG. 2B) that defines a nozzle receptacle, and an opening 224 that becomes closed-off when assembled together with nozzle 228.

As illustrated in FIG. 2E, a thickness of first wing 212 decreases in a direction from a center of main body 208 toward a distal end 212*a* of first wing 212, forming a taper. A thickness of second wing 216 decreases in a direction from the center of main body 208 toward a distal end 216*a* of second wing 216, forming a taper. Distal end 212*a* of first wing 212 opposes distal end 216*a* of second wing 216. The tapered first and second wings 212, 216 allow a flexible wall to seal to front face 221 and rear face 222 from distal end 212*a* to distal end 216*a*, providing a surface area for heat weld bonding and enabling the flexible wall to bond to bag connector 204 in a manner that forms an air-tight seal to a compartment defined by the flexible wall.

Nozzle 228 includes a hollow body 232 having a wall that defines an interior volume within hollow body 232. At least one orifice 236 forms a fluid communication between the interior volume of nozzle 228 and a volume of a compartment above nozzle 228, that is, above with respect to the orientation shown. As shown in FIGS. 2E and 2F, nozzle 228 can include two orifices 236, or more. As can be seen from FIGS. 2A, 2B, 2C, and 2E, nozzle 228 is seated within the nozzle receptacle 205 of bag connector 204. Orifice 236 of nozzle 228 and opening 224 of bag connector 204 are positioned such that a fluid communication is formed between the interior volume of hollow body 232 and the outside of bag closure 200. When heat welded to a flexible wall, the fluid connection can be formed between the interior volume of hollow body 232 and the inside of a compartment defined by the flexible wall.

Nozzle 228 includes a tip 252. Orifice 236 can be defined through tip 252 of nozzle 228. Tip 252 of nozzle 228 extends through opening 224 of bag connector 204, protruding beyond bag connector 204 such that, when heat welded to a flexible wall, tip 252 is disposed within a compartment defined by the flexible wall. The compartment can be a bag. In certain embodiments, tip 252 is or includes a dome 256. At least one recess 260, for example, two recesses 260, can be formed on respective opposing sides of dome 256. Orifices 236 can be defined within recesses 260 of dome 256, and a flat top surface 264 of dome 256 can be closed, for example, to provide a closed end or closed most distal axial end. Alternatively, dome 256 can have an apex. Thus, orifices 236 direct liquid laterally, or at an angle of less than 90°, from dome 256 and into the compartment formed by the flexible wall.

Bag connector 204 and nozzle 228 complement one another such that bag connector 204 and nozzle 228 are mechanically connected together, forming bag closure 200. For example, hollow body 232 of nozzle 228 can include an outer surface 240 having a cylindrical shape and nozzle receptacle 205 of bag connector 204 defines an interior cylindrical shape that complements the cylindrical shape of outer surface 240 and nozzle 228 can be snugly seated within bag connector 204. Outer surface 240 of hollow body 232 and nozzle receptacle 205 can have other cross-sectional shapes, such as star shapes, polygonal shapes, or any shapes that complement one another.

Outer surface 240 of hollow body 232 and inner surface 220 of main body 208 can have other shapes and structural locking features that complement one another, further securing bag connector 204 and nozzle 228 together. For example, inner surface 220 of main body 208 can further define at least one annular groove 218 within nozzle receptacle 205 and outer surface 240 of the wall of nozzle 228 can have at least one annular protrusion 272 that fits within annular groove 218. As can be seen in FIG. 2B, nozzle receptacle 205 can be provided with more than one annular groove 218, for example two annular grooves 218 or more. Likewise, outer surface 240 of hollow body 232 of nozzle 228 can have more than one annular protrusion 272, for example two annular protrusions 272 or more that complement the annular grooves of nozzle receptacle 205. The annular protrusions 272 fit within annular grooves 218 and further secures bag connector 204 to nozzle 228. Other male and female type connections can further secure bag connector 204 and nozzle 228 together.

Nozzle 228 can further include a tube seat 244 that is shaped to receive and secure a tube therein. For example, tube seat 244 can include an inner wall that defines a tube or cylindrical shape for a conduit or tube to fit within. Tube seat 244 can be formed of a non-polypropylene thermoplastic, for example, polycarbonate or polyvinyl chloride. Thus, a conduit or tube can properly couple to nozzle 228 via tube seat 244. Tube seat 244 can include a ledge 248 and bag connector 204 can include a bottom edge 210 that abuts ledge 248.

Figure 3B:
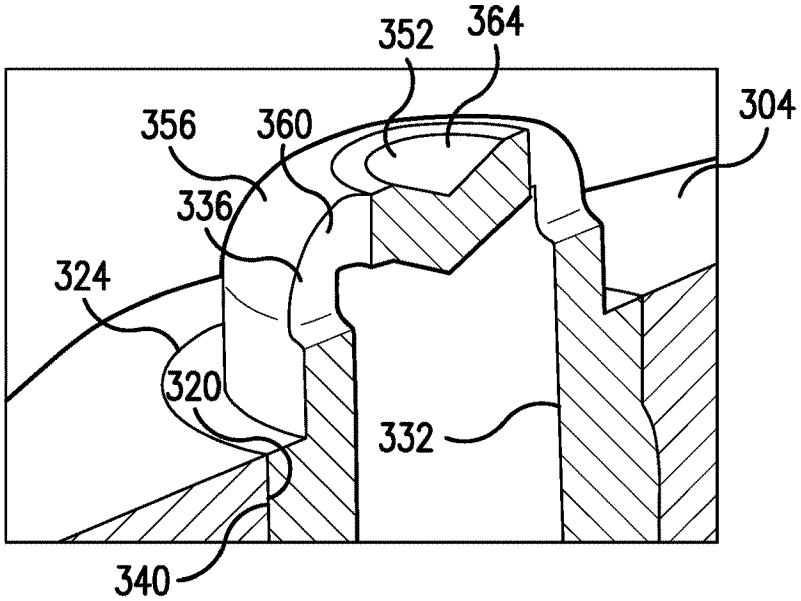
FIG. 3B is an enlarged cross-sectional view of the nozzle tip portion of the bag closure shown in FIG. 3A.
Figure 3A:
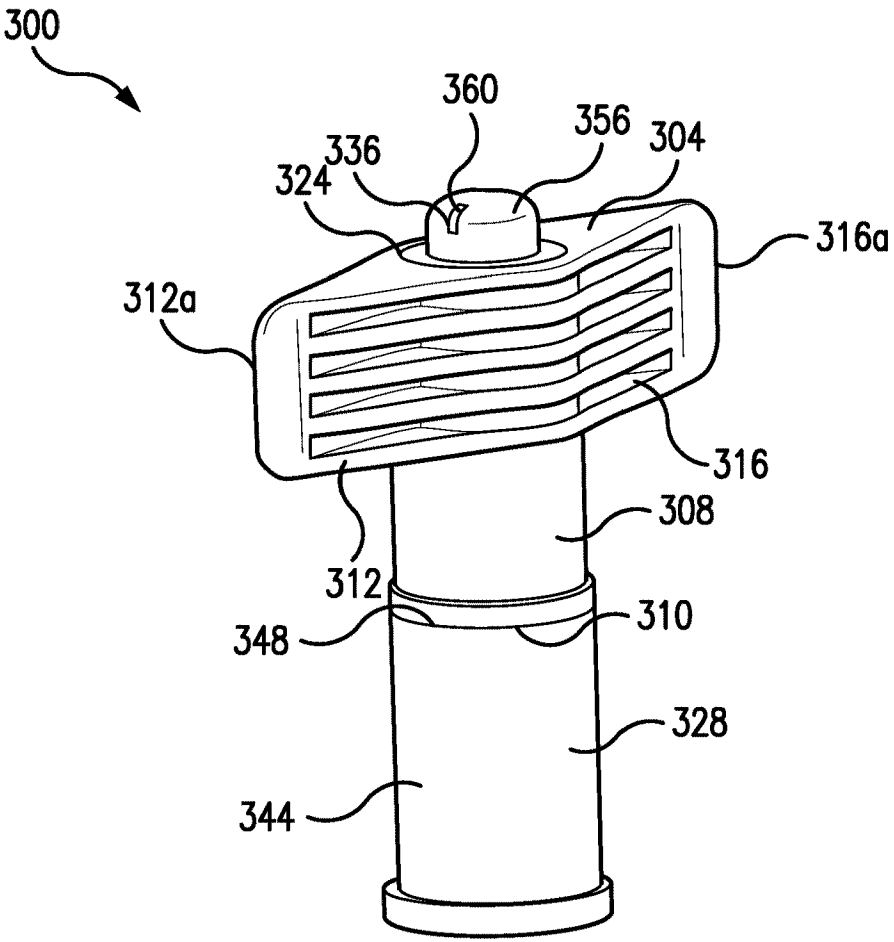
FIG. 3A is a perspective view of a bag closure according to another embodiment of the present invention.

FIG. 3A is a perspective view of a bag closure 300 according to another embodiment of the present invention. FIG. 3B is an enlarged cross-sectional view of the nozzle tip (352) of bag closure 300 shown in FIG. 3A. Bag closure 300 is the same as the bag closure shown in FIGS. 2A-2F, but for a different shaped orifice 336 of the nozzle, in this case, nozzle 328.

Bag closure 300 includes a bag connector 304 and nozzle 328. Bag connector 304 includes a main body 308, a first wing 312, and a second wing 316. Each of first wing 312 and second wing 316 extends in a direction laterally, from a respective opposing side of main body 308. A thickness of first wing 312 decreases in a direction from a center of main body 308 toward a distal end 312*a* of first wing 312, forming a taper. A thickness of second wing 316 decreases in a direction from the center of main body 308 toward a distal end 316*a* of second wing 316, forming a taper. Main body 308 includes an inner surface 320 that defines a nozzle receptacle, and an opening 324.

Nozzle 328 includes a hollow body 332 having a wall that defines an interior volume within hollow body 332. At least one orifice 336 forms a fluid communication between the interior volume and the outside of nozzle 328. As shown in FIG. 3B, nozzle 328 includes two orifices 336, although nozzle 328 can include more than two orifices. Nozzle 328 is seated within the nozzle receptacle of bag connector 304, such that an outer surface 340 of nozzle 328 abuts inner surface 320. Orifice 336 of nozzle 328 and opening 324 of bag connector 304 are positioned such that a fluid communication is formed between the interior volume of hollow body 332 and the outside of bag closure 300, while a fluid-tight seal is provided between bag connector 304 and nozzle 328 at opening 324.

Nozzle 328 includes a tube seat 344 that is shaped to receive and secure a conduit or tube therein. For example, tube seat 344 can include an inner wall that defines a tube or cylindrical shape for a conduit or tube to fit within. Tube seat 344 can include a ledge 348 and bag connector 304 can include a bottom edge 310 that abuts ledge 348.

Nozzle 328 includes a tip 352 as best seen in FIG. 3B. Orifice 336 can be defined through tip 352 of nozzle 328. A second orifice is also provided across tip 352 and opposite orifice 336. Tip 352 of nozzle 328 extends through opening 324 of bag connector 304, protruding beyond bag connector 304 such that tip 352 is disposed within the compartment of the flexible bag when bag closure 300 is connected to flexible wall that forms a flexible bag. As shown in FIGS. 3A and 3B, tip 352 can be or include a dome 356. Orifices 336 are formed as slots 360 having a length disposed in a direction from a base of dome 356 to a flat top surface 364 of dome 356 but not extending to the center of dome 356. As such, the axially-centered end of nozzle 328 is closed, as can be seen. Alternatively, dome 356 can have an apex.

Figure 4B:
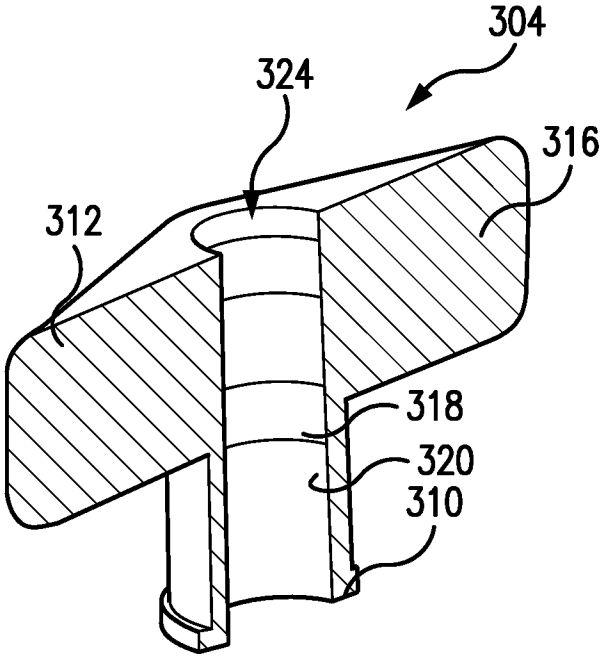
FIG. 4B is a cross-sectional view of the bag connector shown in FIG. 4A.
Figure 4A:
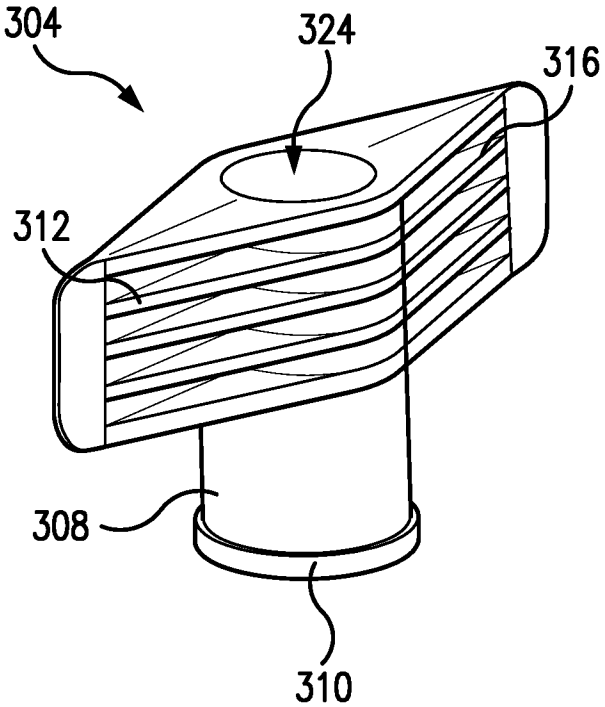
FIG. 4A is a perspective view of the bag connector of the bag closure shown in FIGS. 3A and 3B.

FIG. 4A is a perspective view of bag connector 304 of bag closure 300 shown in FIGS. 3A and 3B. FIG. 4B is a lateral cross-sectional view of bag connector 304 shown in FIG. 4A. Bag connector 304 includes main body 308, first wing 312, and second wing 316. As described with reference to FIGS. 3A and 3B, each of first wing 312 and second wing 316 extends in a direction laterally from a respective opposing side of main body 308. Main body 308 includes an inner surface 320 that defines the nozzle receptacle, and an opening 324 that forms a fluid communication between the nozzle receptacle and the outside. Inner surface 320 defines two annular grooves 318 in the nozzle receptacle. Main body 308 includes a bottom edge 310.

Figure 5B:
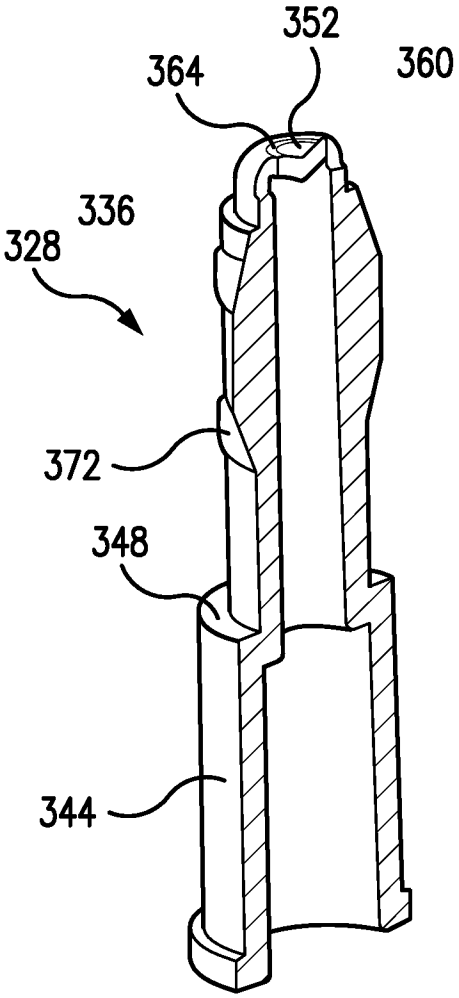
FIG. 5B is a cross-sectional view of the nozzle shown in FIG. 5A.
Figure 5A:
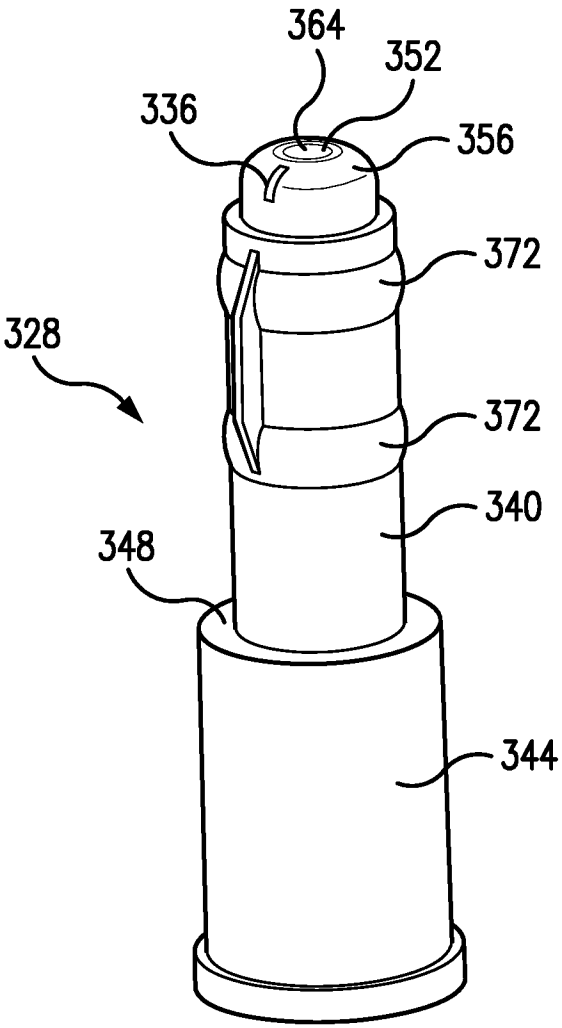
FIG. 5A is a perspective view of the nozzle of the bag closure shown in FIGS. 3A and 3B.

FIG. 5A is a perspective view of nozzle 328 of bag closure 300 shown in FIGS. 3A and 3B. FIG. 5B is a cross-sectional view taken axially through nozzle 328 shown in FIG. 5A. Nozzle 328 includes a hollow body 332 having a wall that defines an interior volume within hollow body 332. Nozzle 328 includes an outer surface 340 having two annular protrusions 372 extending therefrom. Nozzle 328 includes a tube seat 344 that is shaped to receive and secure a conduit or tube therein. Tube seat 344 can include a ledge 348 on which a bottom surface of a bag connector can be shouldered. As described above with reference to FIGS. 3A and 3B, at least one orifice 336 forms a fluid communication between the interior volume and the outside of nozzle 328. As shown in FIG. 5B, nozzle 328 includes two orifices 336, although nozzle 328 can have more than two orifices. Nozzle 328 includes tip 352. Orifice 336 can be defined through tip 352 of nozzle 328. Tip 352 can be or include a dome 356. In the embodiment shown, orifices 336 are slots 360 having a length disposed in a direction from a base of dome 356 to the edge of a flat top 364 of dome 356.

Figure 6B:
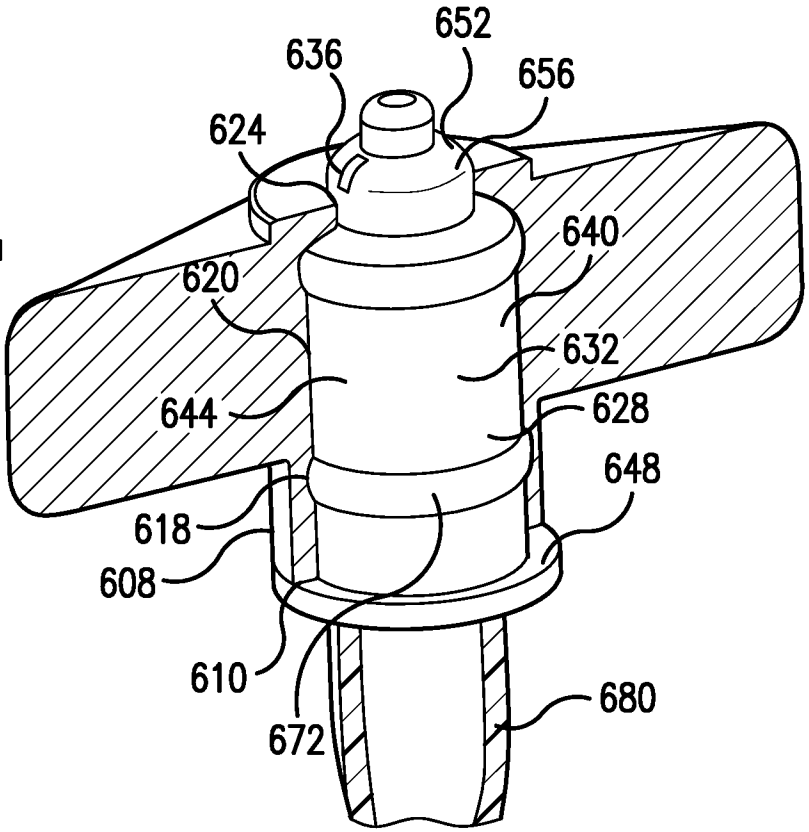
FIG. 6B is a partial cross-sectional view of the bag closure shown in FIG. 6A with the bag connector, but not the nozzle, shown in cross-section.
Figure 6A:
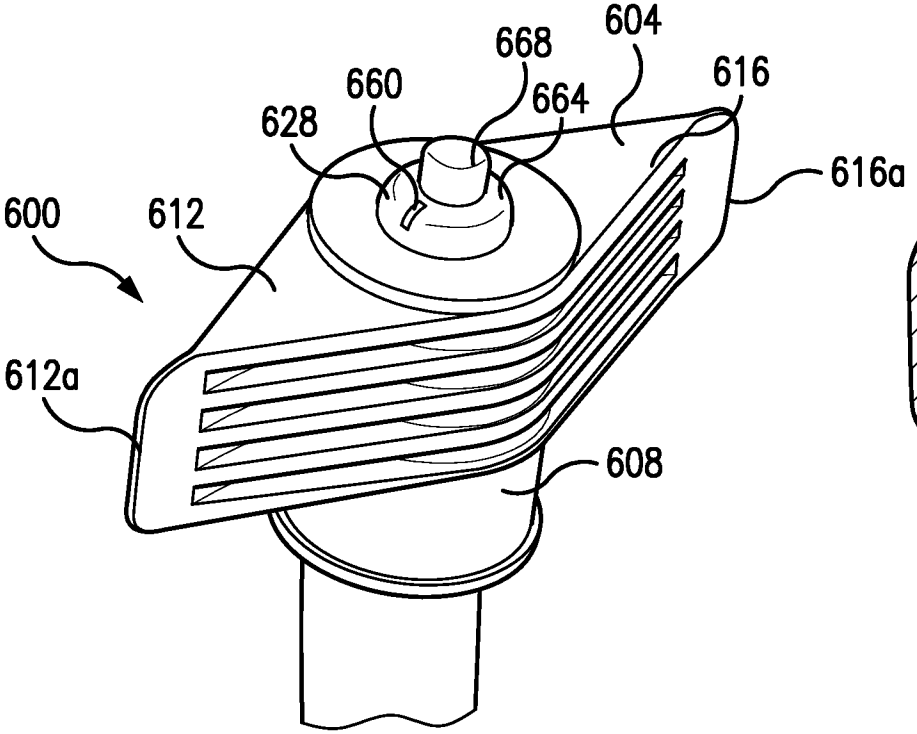
FIG. 6A is a perspective view of a bag closure according to yet another embodiment of the present invention.

FIG. 6A is a perspective view of a bag closure 600 according to yet another embodiment of the present invention, showing a bag connector 604 and nozzle 628 assembled together to form an assembly. FIG. 6B is a partial cross-sectional view taken laterally through bag connector 604 shown in FIG. 6A. Nozzle 628 is not shown in cross-section in FIG. 6B, and FIG. 6B shows an outer surface 640 of nozzle 628.

As shown in FIGS. 6A and 6B, bag closure 600 includes bag connector 604 and nozzle 628. Bag connector 604 can be made of polypropylene, for example, if intended to bond to a flexible wall of a polypropylene material, a polypropylene-containing material, or a similar polyolefin material. Nozzle 628 can be made of a different polymer, such as non-polypropylene thermoplastic, if intended to heat weld to a different flexible wall material. Accordingly, nozzle 628 can easily couple to a tube made of the same or a similar material. In an example, nozzle 628 can be made of polycarbonate or polyvinyl chloride and can couple to a conduit or tube made of polycarbonate or polyvinyl chloride.

Bag connector 604 and nozzle 628 can be manufactured such that bag connector 604 is formed around the sidewall, or a portion of the sidewall, of nozzle 628. In such a configuration, bag connector 604 and nozzle 628 are mechanically coupled together and cannot easily be separated from one another. For example, bag connector 604 and nozzle 628 can be manufactured by co-molding bag connector 604 around nozzle 628. Alternatively, forming bag connector 604 around nozzle 628 can comprise over-molding bag connector 604 around a pre-made nozzle 628. Nozzle 628 and bag connector 604 can be 3D printed, separately, or together. A two-shot molding process can be used. Nozzle 628 can be separately formed, placed in a mold, and then over-molded with a different material to form bag connector 604. Nozzle 628 can be separately formed, and then bag connector 604 can be 3D printed over nozzle 628.

Bag connector 604 includes a main body 608, a first wing 612, and a second wing 616. Each of first wing 612 and second wing 616 extends in a direction laterally from a respective opposing side of main body 608. Main body 608 includes an inner surface 620 that defines a nozzle receptacle, and an opening 624 to the nozzle receptacle.

A thickness of first wing 612 decreases in a direction from a center of main body 608 toward a distal end 612*a* of first wing 612, forming a taper. A thickness of second wing 616 decreases in a direction from the center of main body 608 toward a distal end 616*a* of second wing 616, forming a taper. Distal end 612*a* of first wing 612 opposes distal end 616*a* of second wing 616. The tapered first and second wings 612, 616 allow a flexible wall to be heat weld sealed to first and second wings 612, 616 all the way to distal ends 612*a*, 616*a*. The design enables a flexible wall to be heat weld bonded to bag connector 604, forming an air tight seal of a compartment defined by the flexible wall.

Nozzle 628 includes a hollow body 632 having a wall that defines an interior volume within hollow body 632. At least one orifice 636 forms a fluid communication between the interior volume and the outside of nozzle 628. Nozzle 628 is seated within the nozzle receptacle of bag connector 604. Orifice 636 of nozzle 628, and opening 624 of bag connector 604, are assembled or formed such that a fluid communication is formed between the interior volume of hollow body 632 and the outside of bag closure 600, and a fluid-tight seal is provided between bag connector 604 and nozzle 628 at opening 624. When heat weld bonded to a flexible wall, a fluid communication is formed between the interior volume of hollow body 632 and the inside of a compartment defined by the flexible wall.

Nozzle 628 includes a tip 652. Orifice 636 can be defined through tip 652 of nozzle 628. Tip 652 of nozzle 628 extends through opening 624 of bag connector 604, protruding beyond bag connector 604. When bag closure is heat weld bonded to a flexible wall or flexible bag, tip 652 is disposed within a compartment defined by the flexible wall. In certain embodiments, tip 652 is or includes a dome 656. In the embodiment shown, orifice 636 is a slot 660 having a length disposed in a direction from a base of dome 656 to the edge of a flat top surface 664 of dome 656. A particulate trap 668 protrudes from top surface 664 of dome 656. Alternatively, dome 656 can have an apex.

As mentioned above, bag connector 604 and nozzle 628 complement one another such that bag connector 604 and nozzle 628 are mechanically connected together, forming bag closure 600. For example, hollow body 632 of nozzle 628 can include an outer surface 640 having a cylindrical shape and the nozzle receptacle of bag connector 604 can have an inner cylindrical shape that complements the outer cylindrical shape of outer surface 640. Outer surface 640 of hollow body 632 and the nozzle receptacle can have other cross-sectional shapes, such as star shapes, polygonal shapes, or any other shapes that complement one another.

Outer surface 640 of hollow body 632 and inner surface 620 of main body 608 can have other shapes and structural locking features that complement one another, further securing bag connector 604 to nozzle 628. For example, inner surface 620 of main body 608 can further define at least one inner annular groove 618 within the nozzle receptacle, and outer surface 640 of the wall of nozzle 628 has at least one outer annular protrusion 672 that fits within inner annular groove 618. As can be seen in FIG. 6B, the nozzle receptacle defines two inner annular grooves 618, although any number of grooves can be provided. Likewise, outer surface 640 of hollow body 632 of nozzle 628 has two outer annular protrusions 672, although any number of outer annular protrusions can be provided and that number can complement the number of inner annular grooves. The annular protrusions 672 fit within annular grooves 618 and further secure bag connector 604 and nozzle 628 together.

Nozzle 628 can further include a tube seat 644 that is shaped to receive and secure a conduit therein, for example, tube 680. In the embodiment shown, tube seat 644 is disposed inside the nozzle receptacle. Tube seat 644 can include an inner wall that defines a tubular or cylindrical shape for tube 680 to fit within. Tube seat 644 can be made of or otherwise comprise the same material as the material of tube 680 or another heat weld compatible material. For example, tube 680 can comprise polycarbonate, polyvinyl chloride, or another non-polypropylene thermoplastic, and tube seat 644 can comprise polycarbonate, polyvinyl chloride, or another non-polypropylene thermoplastic. Thus, tube 680 can properly couple to nozzle 628 via tube seat 644. Tube seat 644 can include a ledge 648 and bag connector 604 can include a bottom edge 610 that abuts ledge 648.

Figure 7:
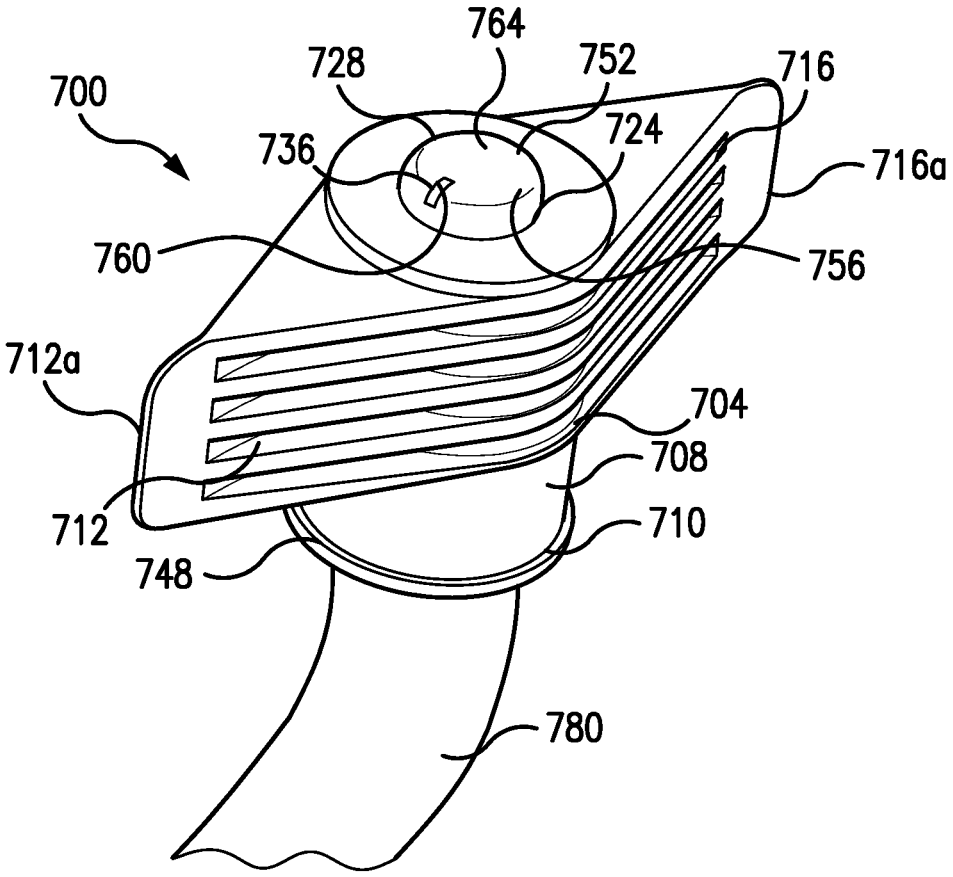
FIG. 7 is a perspective view of a bag closure according to yet another embodiment of the present invention.

FIG. 7 is a perspective view of a bag closure 700 according to yet another embodiment of the present invention. Bag closure 700 is the same as bag closure 600 shown in FIGS. 6A and 6B, with the exception that nozzle 728 does not include a particulate trap, such as particulate trap 668 shown in FIGS. 6A and 6B. Bag closure 700 includes a bag connector 704 and nozzle 728. Bag connector 704 includes a main body 708, a first wing 712, and a second wing 716. Each of first wing 712 and second wing 716 extends laterally from a respective opposing side of main body 708. A thickness of first wing 712 decreases in a direction from a center of main body 708 toward a distal end 712*a* of first wing 712, forming a taper. A thickness of second wing 716 decreases in a direction from the center of main body 708 toward a distal end 716*a* of second wing 716, forming a taper. Main body 708 includes an inner surface (not shown) that defines a nozzle receptacle, and an opening 724 that forms a fluid connection between the nozzle receptacle the outside of main body 708.

Nozzle 728 includes a hollow body (not shown) having a wall that defines an interior volume within the hollow body. At least one orifice 736 forms a fluid connection between the interior volume and outside of nozzle 728. Nozzle 728 is seated within the nozzle receptacle of bag connector 704. Orifice 736 of nozzle, and opening 724 of bag connector 704, are positioned such that a fluid communication is formed between the interior volume of the hollow body and the outside of bag closure 700.

Nozzle 728 includes a tube seat (not shown) that is shaped to receive and secure a tube 780 therein. The tube seat is formed into or otherwise disposed inside of the nozzle receptacle. The tube seat can include an inner wall that defines a tubular or cylindrical shape within which tube 780 can fit. The tube seat can include a ledge 748 and bag connector 704 can include a bottom edge 710 that abuts ledge 748.

Nozzle 728 includes a tip 752. Orifice 736 can be defined through tip 752 of nozzle 728. Tip 752 of nozzle 728 extends through opening 724 of bag connector 704, protruding beyond bag connector 704 such that it would be disposed within a compartment formed by a flexible bag heat welded to bag closure 700. Tip 752 can be or comprise a dome 756. Orifice 736 is shown as a slot 760 having a length that extends in a direction from a base of dome 756 to a flat top surface 764 of dome 756. Alternatively, dome 756 can have an apex.

Figure 8A:
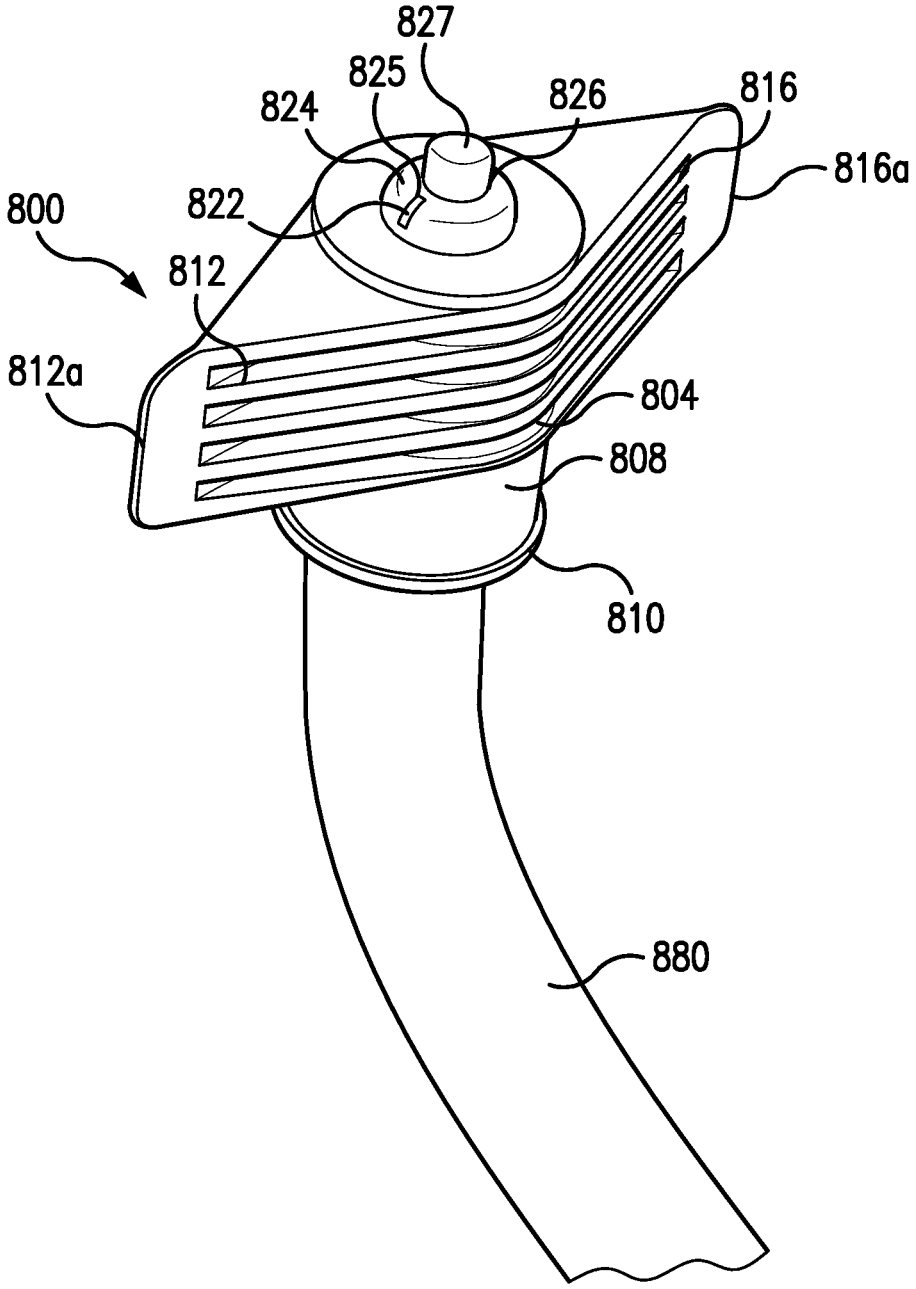
FIG. 8A is a perspective view of a bag closure according to yet another embodiment of the present invention.
Figure 8C:
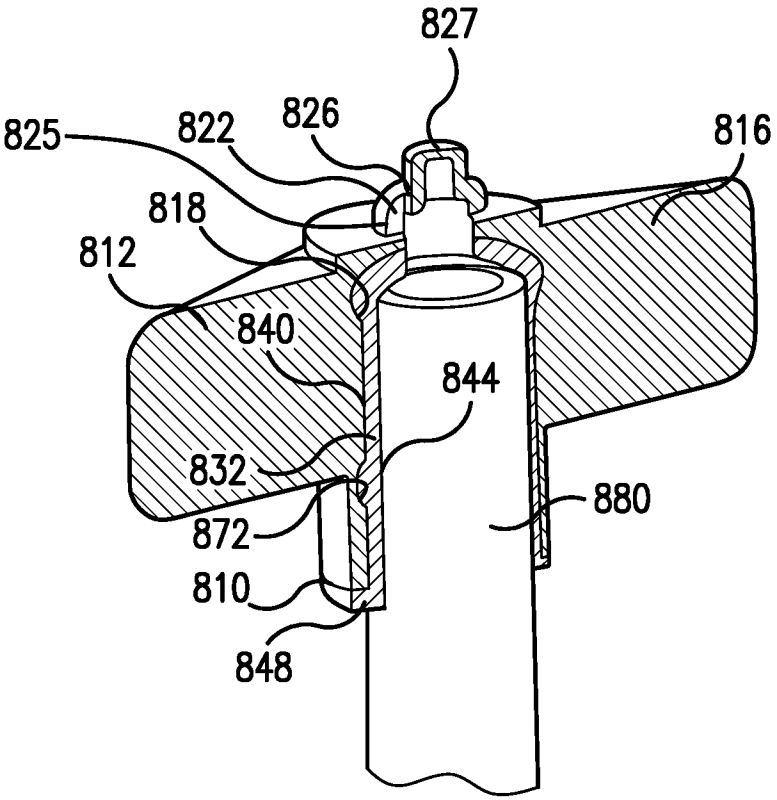
FIG. 8C is a partial cross-sectional view of the bag closure shown in FIGS. 8A and 8B showing both the bag connector and the nozzle in cross-section and a tube inserted into the tube seat of the nozzle.
Figure 8B:
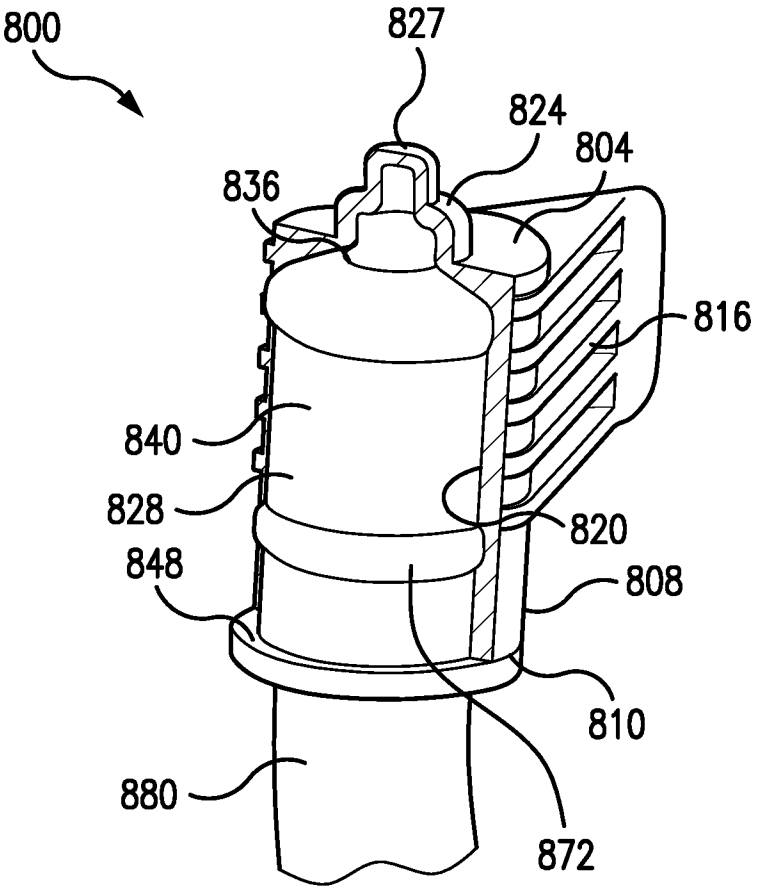
FIG. 8B is a partial cross-sectional view of the bag closure of FIG. 8A showing just the bag connector in cross-section.

FIG. 8A is a perspective view of a bag closure 800 according to yet another embodiment of the present invention, connected to a tube 880. FIG. 8B is a partial cross-sectional view of bag closure 800 shown in FIG. 8A, showing a cross-sectional view of a bag connector 804, and a nozzle 828 not in cross-section. Nozzle 828 has an outer surface 840. FIG. 8C is a partial cross-sectional view of bag closure 800 shown in FIG. 8A, showing a cross-sectional view of a bag connector 804 and nozzle 828, and showing tube 880 not in cross-section. As can be seen, tube 880 is seated inside of tube seat 844 of nozzle 828. Bag closure 800 includes a bag connector 804 and a nozzle 828. Bag connector 804 can be made of a heat weld compatible material with respect to a flexible wall material that bag connector 800 is intended to be used with. Bag connector 804 can be made of or comprise polypropylene and can be designed to be used with a flexible wall material that contains or comprises polypropylene or a polypropylene blend. The material of bag connector 804 can be selected to heat weld bond with the material of the flexible wall with which bag closure 800 is intended to be used.

Nozzle 828 can be made of a polymer that is different from polypropylene, such as polycarbonate, polyvinyl chloride, or another non-polypropylene thermoplastic. Accordingly, nozzle 828 can easily couple to a tube 880 made of polycarbonate, polyvinyl chloride, or another non-polypropylene thermoplastic. The materials of nozzle 828 and tube 880 can be the same or a similar material, or can otherwise be matched to enable appropriate bonding therebetween, for example, solvent bonding therebetween. For example, nozzle 828 can be made of polycarbonate and tube 880 can be made of polyvinyl chloride, which together can readily bond by solvent bonding.

Bag connector 804 and nozzle 828 can be manufactured such that bag connector 804 is formed around nozzle 828. In such a configuration, bag connector 804 and nozzle 828 are mechanically coupled together and cannot easily be separated from one another. For example, bag connector 804 and nozzle 828 can be manufactured by co-molding bag connector 804 around nozzle 828. Alternatively, forming bag connector 804 around nozzle 828 can comprise over-molding bag connector 804 around nozzle 828. Nozzle 828 and bag connector 804 can be 3D printed, separately, or together. A two-shot molding process can be used. Nozzle 828 can be separately formed, placed in a mold, and then over-molded with a different material to form bag connector 804. Nozzle 828 can be separately formed, and then bag connector 804 can be 3D printed over nozzle 828.

Bag connector 804 includes a main body 808, a first wing 812, and a second wing 816. Each of first wing 812 and second wing 816 extends laterally from a respective opposing side of main body 808. Each of first wing 812 and second wing 816 further includes a front face and a rear face each of which bonds to a material-matched flexible wall. Main body 808 includes an inner surface 820 that defines a nozzle receptacle, and an opening 822 that forms a fluid communication between the nozzle receptacle and the outside of main body 808.

As mentioned above, bag connector 804 can include polypropylene so that the front face and the rear face properly bond to a flexible wall comprising a polypropylene material. A thickness of first wing 812 decreases in a direction from a center of main body 808 toward a distal end 812*a* of first wing 812, forming a taper. A thickness of second wing 816 decreases in a direction from the center of main body 808 toward a distal end 816*a* of second wing 816, forming a taper. Distal end 812*a* of first wing 812 opposes distal end 816*a* of second wing 816. The tapered first and second wings 812, 816 allow a flexible wall to seal to the front face and to the rear face of bag connector 804 all the way to distal ends 812*a*, 816*a*. Heat weld bonding can form an air tight seal between the compartment of the flexible wall and bag connector 804.

Nozzle 828 includes a hollow body 832 having a wall that defines an interior volume within hollow body 832. At least one orifice 836 forms a fluid communication between the interior volume and the outside of nozzle 828. As shown, nozzle 828 is seated within the nozzle receptacle of bag connector 804. Orifice 836 of nozzle 828, and opening 822 of bag connector 804, are positioned such that a fluid communication is formed between the interior volume of hollow body 832 and the outside of bag closure 800. When incorporated with a flexible wall, the fluid communication can be formed between the interior volume of hollow body 832 and the inside of a compartment define by the flexible wall.

Main body 808 further includes a dome 824 protruding from a top end of main body 808. Openings 822 are defined through dome 824. Openings 822 are each in the form of a slot 825 having a length disposed in a direction from a base of dome 856 to a flat top surface 826 of dome 824. Alternatively, dome 856 can have an apex. A particulate trap 827 protrudes from flat top surface 826 of dome 824. Orifice 836 of nozzle 828 is in fluid communication with an inside ceiling of dome 824. Accordingly, fluid flowing through nozzle 828 flows through orifice 836, through slots 825, and out of bag closure 800.

As mentioned above, bag connector 804 and nozzle 828 complement one another such that bag connector 804 and nozzle 828 are mechanically connected together, forming bag closure 800. For example, hollow body 832 of nozzle 828 can include an outer surface 840 having a cylindrical shape and the nozzle receptacle of bag connector 804 complements the cylindrical shape, such that nozzle 828 is seated within bag connector 804.

Outer surface 840 of hollow body 832 and inner surface 820 of main body 808 can have other shapes and structural features that complement one another, further securing bag connector 804 to nozzle 828. For example, inner surface 820 of main body 808 can further define at least one annular groove 818 within the nozzle receptacle, and outer surface 840 of the wall of nozzle 828 can have at least one annular protrusion 872 that fits within annular groove 818. As can be seen in FIG. 8B, the nozzle receptacle can define more than one annular groove 818, such as two annular grooves 818, or more. Likewise, outer surface 840 of hollow body 832 of nozzle 828 can have more than one annular protrusion 872, such as two annular protrusions 872, or more. The annular protrusions 872 fit within annular grooves 818 and further secure bag connector 804 to nozzle 828. Other male and female type connections can further secure bag connector 804 and nozzle 828 together.

Tube seat 844 is shaped to receive and secure tube 880 therein. For example, tube seat 844 can include an inner wall that defines a tubular or cylindrical shape within which tube 880 can snugly fit. Tube 880 can be solvent bonded to tube 844. Tube seat 844 can comprise a non-polypropylene thermoplastic, for example, polycarbonate or polyvinyl chloride. Thus, tube 880 can properly couple to nozzle 828 via tube seat 844. In the embodiment shown, tube seat 844 is disposed inside the nozzle receptacle. Tube seat 844 can include a ledge 848 and bag connector 804 can include a bottom edge 810 that abuts or is shouldered on ledge 848.

Figure 9:
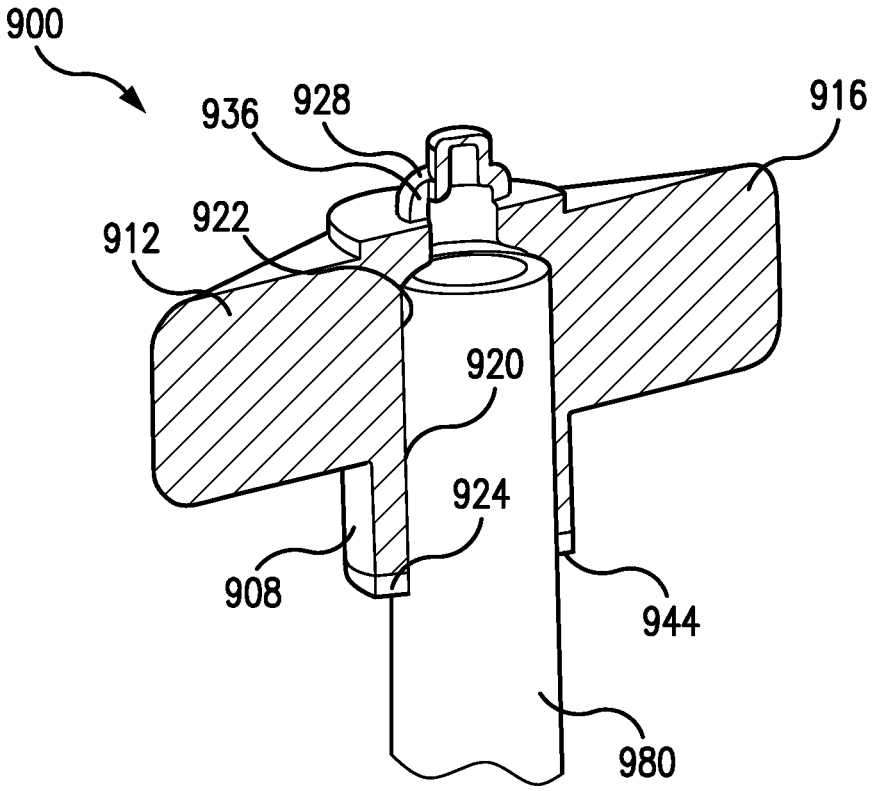
FIG. 9 is a cross-sectional view of a one-piece bag closure according to yet another embodiment of the present invention, with a tube inserted into the bag closure.

FIG. 9 is a cross-sectional view of a bag closure 900 according to yet another embodiment of the present invention, showing a tube 980 disposed within bag closure 900. Bag closure 900 includes a main body 908, a first wing 912, a second wing 916, an inner cavity 920, a nozzle 928, and a tube port 944. Bag closure 900 can be monolithic, and can be made of a first polymer, a polymeric blend comprising the first polymer, or a polymeric material that is heat-bond compatible with the first polymer.

As an example, the first polymer can be polyvinyl chloride and tube 980 can be made of polyvinyl chloride. In another example, bag closure 900 comprises a polymeric material that is heat-bond compatible with the first polymer. The polymeric material can be polycarbonate or polyvinyl chloride.

Each of first wing 912 and second wing 916 extends laterally from a respective opposing side of main body 908. Inner cavity 920 has a first end 922 and a second end 924. First end 922 of inner cavity 920 terminates with nozzle 928. Second end 924 of inner cavity 920 at least partially defines tube port 944. Nozzle 928 includes at least one orifice 936 that forms a fluid communication between inner cavity 920 and the outside of bag closure 900.

Referring to FIGS. 1 and 9, when bag closure shown in FIG. 1 is replaced with bag closure 900 shown in FIG. 9, bag closure 900 is heat weld bonded to flexible wall 104 shown in FIG. 1, and orifice 936 forms a fluid communication between inner cavity 920 and compartment 106. A fluid communication is also formed between tube port 944 and compartment 106 through inner cavity 920. Flexible wall 104 defines compartment 106 and is heat-bonded to bag closure 900 at an end of compartment 106. With such a construction, the closed end of compartment 106 is closed but-for a through-passage from tube port 944 to the interior of compartment 106.

The present invention includes the following aspects/embodiments/features in any order and/or in any combination:

1. A bag closure comprising:
   - a bag connector comprising a main body, a first wing, and a second wing, each of the first wing and the second wing extending laterally from a respective opposing side of the main body, the main body comprising an inner surface that defines a nozzle receptacle, and an opening that forms a fluid communication between the nozzle receptacle and an outside of the main body, the bag connector comprising polypropylene; and
   - a nozzle comprising a hollow body having a wall that defines an interior volume within the hollow body, and at least one orifice that forms a fluid communication between the interior volume and an outside of the nozzle, the nozzle comprising a non-polypropylene thermoplastic, wherein the nozzle is seated within the nozzle receptacle of the bag connector, and the least one orifice and the opening are positioned such that a fluid communication is formed between the interior volume of the hollow body and an outside of the bag closure.

2. The bag closure of any preceding or following embodiment/feature/aspect, wherein the non-polypropylene thermoplastic comprises polycarbonate.
3. The bag closure of any preceding or following embodiment/feature/aspect, wherein the non-polypropylene thermoplastic comprises polyvinyl chloride.
4. The bag closure of any preceding or following embodiment/feature/aspect, wherein the hollow body comprises an outer surface having a cylinder shape and the nozzle receptacle compliments the cylinder shape.
5. The bag closure of any preceding or following embodiment/feature/aspect, wherein a thickness of each of the first wing and the second wing gradually decreases in a direction toward a respective opposing end.
6. The bag closure of any preceding or following embodiment/feature/aspect, wherein the nozzle further comprises a tube seat configured to receive and secure a tube therein, the tube seat comprises the non-polypropylene thermoplastic, and the non-polypropylene thermoplastic comprises polycarbonate.
7. The bag closure of any preceding or following embodiment/feature/aspect, wherein the tube seat comprises a ledge and the bag connector comprises a bottom edge that abuts the ledge.
8. The bag closure of any preceding or following embodiment/feature/aspect, wherein the nozzle comprises a tip comprising the at least one orifice.
9. The bag closure of any preceding or following embodiment/feature/aspect, wherein the tip of the nozzle extends through the opening and outside of the bag connector.
10. The bag closure of any preceding or following embodiment/feature/aspect, wherein the tip comprises a dome and the at least one orifice is a slot having a length disposed in a direction from a base of the dome to an apex of the dome.
11. The bag closure of any preceding or following embodiment/feature/aspect, wherein the at least one orifice comprises a first orifice and a second orifice disposed on opposing sides of the dome.
12. The bag closure of any preceding or following embodiment/feature/aspect, wherein the tip of the nozzle further comprises a particulate trap that protrudes from the apex of the dome.
13. The bag closure of any preceding or following embodiment/feature/aspect, wherein the main body further comprises a dome protruding from a top end of the main body, the opening being defined through the dome, and the opening being a slot having a length disposed in a direction from a base of the dome to an apex of the dome.
14. The bag closure of any preceding or following embodiment/feature/aspect, wherein the main body further comprises a particulate trap that protrudes from the apex of the dome.
15. The bag closure of any preceding or following embodiment/feature/aspect, wherein the inner surface of the main body further defines at least one annular groove within the nozzle receptacle and an outer surface of the wall of the nozzle defines at least one annular protrusion that fits within the annular groove.
16. A container system comprising:

at least one flexible wall defining a compartment, the at least one flexible wall comprising polypropylene; and a bag closure comprising a bag connector and nozzle, the bag closure comprising a main body, a first wing, and a second wing, the first wing and the second wing each extending laterally from a respective opposing side of the main body, the main body comprising an inner surface that defines a nozzle receptacle, and an opening that forms a fluid communication between the nozzle receptacle and an outside of the main body, the bag connector comprising polypropylene; and a nozzle comprising a hollow body having a wall that defines an interior volume within the hollow body, and at least one orifice that forms a fluid communication between the interior volume and an outside of the nozzle, the nozzle comprising a non-polypropylene thermoplastic, wherein the bag connector and the nozzle have been formed such that the nozzle is seated within the nozzle receptacle of the bag connector, and a fluid communication is formed between the interior volume of the hollow body and the compartment of the at least one flexible wall.

17. The container system of any preceding or following embodiment/feature/aspect, wherein the non-polypropylene thermoplastic comprises polycarbonate.
18. The container system of any preceding or following embodiment/feature/aspect, wherein the non-polypropylene thermoplastic comprises polyvinyl chloride.
19. The container system of any preceding or following embodiment/feature/aspect, wherein the at least one flexible wall comprises a support adjacent a first end of the at least one flexible wall, and the bag connector is coupled to a second end of the at least one flexible wall, the second end distal from the first end.
20. The container system of claim 16, wherein the bag connector is coupled to the at least one flexible wall at the first wing and the second wing.
21. The container system of any preceding or following embodiment/feature/aspect, wherein a thickness of each of the first wing and the second wing gradually decreases in a direction toward a respective opposing end.
22. The container system of any preceding or following embodiment/feature/aspect, wherein the nozzle further comprises a tube seat configured to receive and secure a tube therein, the tube seat comprises the non-polypropylene thermoplastic, and the non-polypropylene thermoplastic comprises polycarbonate.
23. The container system of any preceding or following embodiment/feature/aspect, wherein the tube seat comprises a ledge and the bag connector comprises a bottom edge that abuts the ledge.
24. The container system of any preceding or following embodiment/feature/aspect, wherein the nozzle comprises a tip comprising the at least one orifice.
25. The container system of any preceding or following embodiment/feature/aspect, wherein the tip of the nozzle extends through the opening, outside of the bag connector, and into the compartment.
26. The container system of any preceding or following embodiment/feature/aspect, wherein the tip comprises a dome and the at least one orifice is a slot having a length disposed in a direction from a base of the dome to an apex of the dome.

27. The container system of any preceding or following embodiment/feature/aspect, wherein the tip of the nozzle further comprises a particulate trap that protrudes from the apex of the dome.

28. The container system of any preceding or following embodiment/feature/aspect, wherein the main body further comprises a dome protruding from a top end of the main body, the opening being defined through the dome, and the opening being a circular through-hole.

29. The container system of any preceding or following embodiment/feature/aspect, wherein the main body further comprises a particulate trap that protrudes from the apex of the dome.

30. The container system of any preceding or following embodiment/feature/aspect, wherein the inner surface of the main body further defines at least one annular groove within the nozzle receptacle and an outer surface of the wall of the nozzle defines at least one annular protrusion that fits within the annular groove.

31. A container system comprising:

at least one flexible wall defining a compartment and comprising a first polymer or a polymeric blend comprising the first polymer, the compartment having an interior; and a bag closure comprising a main body, a first wing, a second wing, an inner cavity, a nozzle, and a tube port, the bag closure comprising the first polymer, a polymeric blend comprising the first polymer, or a polymeric material that is heat-bond compatible with the first polymer, wherein each of the first wing and the second wing extends laterally from a respective opposing side of the main body, the inner cavity has a first end and a second end, the first end of the inner cavity terminates with the nozzle, the second end of the inner cavity at least partially defines the tube port, the nozzle includes at least one orifice that forms a fluid communication between the inner cavity and the compartment, a fluid communication is formed between the tube port and the compartment through the inner cavity, and the at least one flexible wall defining the compartment is heat-bonded to the bag closure at an end of the compartment such that the end of the compartment is closed but-for a through-passage from the tube port to the interior of the compartment.

32. The container system of any preceding or following embodiment/feature/aspect, wherein the first polymer is polyvinyl chloride.

33. The container system of any preceding or following embodiment/feature/aspect, further comprising a tube bonded to the tube port such that a fluid communication is provided through the tube and into the interior of the compartment.

34. The container system of any preceding or following embodiment/feature/aspect, wherein the first polymer is polyvinyl chloride and the tube comprises polyvinyl chloride.

35. The container system of any preceding or following embodiment/feature/aspect, wherein the bag closure comprises a polymeric material that is heat-bond compatible with the first polymer, and the polymeric material that is heat-bond compatible with the first polymer is polycarbonate.

36. A method comprising:

forming an assembly of a bag connector and a nozzle, the nozzle comprising a hollow body having a wall that defines an interior volume within the hollow body, and at least one orifice that forms a fluid communication between the interior volume and an outside of the nozzle, the nozzle comprising a non-polypropylene thermoplastic material, and the forming comprising forming the bag connector around the nozzle to form a bag closure, wherein the bag connector comprises a main body, a first wing, and a second wing, each of the first wing and the second wing extending laterally from a respective opposing side of the main body, the main body comprising an inner surface that defines a nozzle receptacle, and an opening that forms a fluid communication between the nozzle receptacle and an outside of the main body, the bag connector comprising polypropylene, and the forming results in the nozzle being seated within the nozzle receptacle of the bag connector and the least one orifice and the opening being positioned such that a fluid communication is formed between the interior volume of the hollow body and an outside of the bag closure.

37. The method of any preceding or following embodiment/feature/aspect, further comprising forming the nozzle.

38. The method of any preceding or following embodiment/feature/aspect, wherein the forming the bag connector around the nozzle and the forming the nozzle together comprise co-molding the nozzle and the bag connector.

39. The method of any preceding or following embodiment/feature/aspect, wherein the forming the bag connector around the nozzle comprises over-molding the bag connector around the nozzle.

40. The method of any preceding or following embodiment/feature/aspect, further comprising heat-welding the bag connector to the nozzle.

41. The method of any preceding or following embodiment/feature/aspect, wherein the forming the bag connector around the nozzle comprises forming the bag connector in two parts, arranging the two parts around the nozzle, and heat-welding the two parts together.

42. The method of any preceding or following embodiment/feature/aspect, further comprising, subsequent to forming the bag closure, bonding at least one flexible wall defining a compartment, to the bag closure, wherein the at least one flexible wall comprises polypropylene and the bonding forms a fluid communication between the interior volume of the hollow body and the compartment formed by the at least one flexible wall.

43. The method of any preceding or following embodiment/feature/aspect, wherein the at least one flexible wall comprises a bag and the bag comprises a PVC-free material.

44. The method of any preceding or following embodiment/feature/aspect, wherein the bonding the at least one flexible wall to the bag closure comprises heat welding the at least one flexible wall to the first wing and the second wing of the bag connector.

The present invention can include any combination of the various features and embodiments described herein. Any combination of disclosed features herein is considered part of the present invention and no limitation is intended with respect to combinable features.

Applicants specifically incorporate the entire contents of all cited references in this disclosure. Further, when an amount, concentration, or other value or parameter is given as either a range, a preferred range, or a list of upper preferable values and lower preferable values, this is to be understood as specifically disclosing all ranges formed from any pair of any upper range limit or preferred value and any lower range limit or preferred value, regardless of whether ranges are separately disclosed. Where a range of numerical values is recited herein, unless otherwise stated, the range is intended to include the endpoints thereof, and all integers and fractions within the range. It is not intended that the scope of the invention be limited to the specific values recited when defining a range.

Other embodiments of the present invention will be apparent to those skilled in the art from consideration of the present specification and practice of the present invention disclosed herein. It is intended that the present specification and examples be considered as exemplary only with a true scope and spirit of the invention being indicated by the following claims and equivalents thereof.

What is claimed is:

1. A bag closure comprising:

a bag connector comprising a main body, a first wing, and a second wing, each of the first wing and the second wing extending laterally from a respective opposing side of the main body, the main body comprising an inner surface that defines a nozzle receptacle, and an opening that forms a fluid communication between the nozzle receptacle and an outside of the main body, the bag connector comprising polypropylene; and a nozzle comprising a hollow body having a wall that defines an interior volume within the hollow body, and at least one orifice that forms a fluid communication between the interior volume and an outside of the nozzle, the nozzle comprising a non-polypropylene thermoplastic, wherein the nozzle is seated within the nozzle receptacle of the bag connector, and the least one orifice and the opening are positioned such that a fluid communication is formed between the interior volume of the hollow body and an outside of the bag closure, the nozzle comprises a tube seat configured to receive and secure a tube therein, the tube seat comprises the non-polypropylene thermoplastic, and the non-polypropylene thermoplastic comprises polycarbonate.

2. The bag closure of claim 1, wherein the hollow body comprises an outer surface having a cylinder shape and the nozzle receptacle compliments the cylinder shape.

3. The bag closure of claim 1, wherein a thickness of each of the first wing and the second wing gradually decreases in a direction toward a respective opposing end.

4. The bag closure of claim 1, wherein the tube seat comprises a ledge and the bag connector comprises a bottom edge that abuts the ledge.

5. The bag closure of claim 1, wherein the nozzle comprises a tip comprising the at least one orifice.

6. The bag closure of claim 5, wherein the tip of the nozzle extends through the opening and outside of the bag connector.

7. The bag closure of claim 6, wherein the tip comprises a dome and the at least one orifice is a slot having a length disposed in a direction from a base of the dome to an apex of the dome.

8. The bag closure of claim 7, wherein the at least one orifice comprises a first orifice and a second orifice disposed on opposing sides of the dome.

9. The bag closure of claim 7, wherein the tip of the nozzle further comprises a particulate trap that protrudes from the apex of the dome.

10. The bag closure of claim 1, wherein the inner surface of the main body further defines at least one annular groove within the nozzle receptacle and an outer surface of the wall of the nozzle defines at least one annular protrusion that fits within the annular groove.

11. A bag closure comprising:

a bag connector comprising a main body, a first wing, and a second wing, each of the first wing and the second wing extending laterally from a respective opposing side of the main body, the main body comprising an inner surface that defines a nozzle receptacle, and an opening that forms a fluid communication between the nozzle receptacle and an outside of the main body, the bag connector comprising polypropylene; and a nozzle comprising a hollow body having a wall that defines an interior volume within the hollow body, and at least one orifice that forms a fluid communication between the interior volume and an outside of the nozzle, the nozzle comprising a non-polypropylene thermoplastic, wherein the nozzle is seated within the nozzle receptacle of the bag connector, and the least one orifice and the opening are positioned such that a fluid communication is formed between the interior volume of the hollow body and an outside of the bag closure, and the main body comprises a dome protruding from a top end of the main body, the opening being defined through the dome, and the opening being a slot having a length disposed in a direction from a base of the dome to an apex of the dome.

12. The bag closure of claim 11, wherein the main body further comprises a particulate trap that protrudes from the apex of the dome.

13. A container system comprising:

at least one flexible wall defining a compartment, the at least one flexible wall comprising polypropylene; and a bag closure comprising a bag connector and nozzle, the bag closure comprising a main body, a first wing, and a second wing, the first wing and the second wing each extending laterally from a respective opposing side of the main body, the main body comprising an inner surface that defines a nozzle receptacle, and an opening that forms a fluid communication between the nozzle receptacle and an outside of the main body, the bag connector comprising polypropylene; and a nozzle comprising a hollow body having a wall that defines an interior volume within the hollow body, and at least one orifice that forms a fluid communication between the interior volume and an outside of the nozzle, the nozzle comprising a non-polypropylene thermoplastic, wherein the bag connector and the nozzle have been formed such that the nozzle is seated within the nozzle receptacle of the bag connector, the main body further comprises a dome protruding from a top end of the main body, the opening being defined through the dome, and the opening being a circular through-hole and further comprises a particulate trap that protrudes from the apex of the dome, and a fluid communication is formed between the interior volume of the hollow body and the compartment of the at least one flexible wall.

14. The container system of claim 13, wherein the at least one flexible wall comprises a first end and a second end, the first end adapted to attach the container system to a fixed or movable object, and the bag connector is coupled to the second end of the at least one flexible wall, the second end distal from the first end.

15. The container system of claim 13, wherein the bag connector is coupled to the at least one flexible wall at the first wing and the second wing.

16. The container system of claim 13, wherein the inner surface of the main body further defines at least one annular groove within the nozzle receptacle and an outer surface of the wall of the nozzle defines at least one annular protrusion that fits within the annular groove.

17. A method comprising:

forming an assembly of a bag connector and a nozzle, the nozzle comprising a hollow body having a wall that defines an interior volume within the hollow body, and at least one orifice that forms a fluid communication between the interior volume and an outside of the nozzle, the nozzle comprising a tip comprising the at least one orifice, the tip comprising a dome, and the at least one orifice is a slot having a length disposed in a direction from a base of the dome to an apex of the dome, the nozzle comprising a non-polypropylene thermoplastic material, and the forming comprising forming the bag connector around the nozzle to form a bag closure, wherein the bag connector comprises a main body, a first wing, and a second wing, each of the first wing and the second wing extending laterally from a respective opposing side of the main body, the main body comprising an inner surface that defines a nozzle receptacle, and an opening that forms a fluid communication between the nozzle receptacle and an outside of the main body, the bag connector comprising polypropylene, and the forming results in the nozzle being seated within the nozzle receptacle of the bag connector and the tip of the nozzle extending through the opening and outside of the bag connector such that the least one orifice forms a fluid communication is formed between the interior volume of the hollow body and an outside of the bag closure.

18. The method of claim 17, wherein the non-polypropylene thermoplastic comprises polycarbonate or polyvinyl chloride.

* * * * *